US012617596B2

(12) United States Patent
Phung

(10) Patent No.: US 12,617,596 B2
(45) Date of Patent: May 5, 2026

(54) FLOW WRAP PACKAGING STRUCTURES

(71) Applicant: PROAMPAC HOLDINGS INC., Cincinnati, OH (US)

(72) Inventor: Quang T. Phung, Addlestone (GB)

(73) Assignee: ProAmpac Holdings Inc., Cincinnati, OH (US)

( * ) Notice: Subject to any disclaimer, the term of this patent is extended or adjusted under 35 U.S.C. 154(b) by 47 days.

(21) Appl. No.: 18/607,324

(22) Filed: Mar. 15, 2024

(65) Prior Publication Data

US 2024/0308745 A1 Sep. 19, 2024

Related U.S. Application Data

(60) Provisional application No. 63/536,005, filed on Aug. 31, 2023, provisional application No. 63/452,593, filed on Mar. 16, 2023.

(51) Int. Cl.

| | |
|---|---|
| ***B65D 75/12*** | (2006.01) |
| ***B65D 75/26*** | (2006.01) |
| ***B65D 75/58*** | (2006.01) |

(52) U.S. Cl.

CPC ..... *B65D 75/12* (2013.01); *B65D 75/26* (2013.01); *B65D 75/5833* (2013.01)

(58) Field of Classification Search

CPC ..... B65D 75/04; B65D 75/06; B65D 75/12; B65D 75/522

USPC ..... 383/107

See application file for complete search history.

(56) References Cited

U.S. PATENT DOCUMENTS

| | | | | |
|---|---|---|---|---|
| 2,377,005 A * | 5/1945 | Haslacher | B65D 31/08 | 383/122 |
| 4,956,209 A * | 9/1990 | Isaka | B32B 27/18 | 426/106 |
| 5,009,518 A * | 4/1991 | Faltynek | B65D 33/004 | 383/111 |
| 5,804,300 A * | 9/1998 | Maro | B32B 27/08 | 156/244.11 |
| 6,790,468 B1 * | 9/2004 | Mize, Jr. | B65D 75/004 | 428/34.9 |

(Continued)

FOREIGN PATENT DOCUMENTS

| | | | |
|---|---|---|---|
| WO | WO-9702182 A1 * | 1/1997 | A23B 2/30 |

OTHER PUBLICATIONS

International Search Report and Written Opinion dated Jun. 11, 2024, received in PCT/US2024/020308.

*Primary Examiner* — Nathan J Newhouse
*Assistant Examiner* — Nina K Attel
(74) *Attorney, Agent, or Firm* — McLane Middleton, Professional Association

(57) ABSTRACT

A web of sheet material is provided which can be wrapped around a product to form a pack. The sheet material comprises a sealant ply laminated to an outer ply. The sealant ply has a first major surface and a second major surface opposite the first major surface, the first major surface comprising a heat sealable material. The outer ply has a third major surface and a fourth major surface opposite the third major surface, wherein the third major surface faces the second major surface. The web of sheet material comprises a plurality of connected blanks, each blank comprising a plurality of cutouts removing a portion of the outer ply, the cutouts aligned with overlapping portions of transverse heat seal regions of the sheet material.

20 Claims, 27 Drawing Sheets

(56) References Cited

U.S. PATENT DOCUMENTS

| | | | | |
|---|---|---|---|---|
| 9,498,930 | B2 * | 11/2016 | Coutts | B32B 27/10 |
| 2007/0131745 | A1 * | 6/2007 | Fitzwater | B65D 5/04<br>229/125.02 |
| 2022/0024191 | A1 | 1/2022 | Jones et al. | |
| 2022/0112000 | A1 * | 4/2022 | Mikol | B65D 75/42 |
| 2023/0051089 | A1 | 2/2023 | Jones et al. | |
| 2023/0365283 | A1 | 11/2023 | Saffar et al. | |
| 2024/0092067 | A1 | 3/2024 | Reid et al. | |

* cited by examiner

FLOW WRAP PACKAGING STRUCTURES

CROSS REFERENCE TO RELATED APPLICATIONS

This application claims the priority benefit of U.S. Provisional Patent Application Ser. No. 63/452,593 filed Mar. 16, 2023 and U.S. Provisional Patent Application Ser. No. 63/536,005 filed Aug. 31, 2023. Each of the aforementioned applications is incorporated herein by reference in its entirety.

BACKGROUND

The present invention relates to packaging structures and, in particular, to flexible packaging structures suitable for products, including food products and others, that are packaged utilizing flow wrap equipment.

Flexible film packages are known in the art to provide a bag or pouch for enclosing products for shipping, handling, and storage. Such packages may be formed of flow wrap type packaging which allows a continuous film to envelop the product during packaging. During the flow wrapping process, a fin seal extending in the machine direction is formed and transverse heat seals are formed at the ends.

The film material is typically a plastic film, such as polyethylene or polypropylene, or a laminate such as two layers of polypropylene or a polyester (PET) laminated to a polyethylene sealant. Flexible film packages have a number of advantages over rigid containers, including lower cost, lighter weight, and smaller storage footprint. Flexible sheet materials comprising paper or film ply laminated to a polymer material are generally known in the art. Laminations comprising a paper-containing ply and a polymer ply are advantageous in that the paper provides good mechanical strength, is made from a renewable resource, can be recyclable or compostable and has good printability, while the polymer ply can impart good barrier properties and heat scalability to the structure.

However, the presence of a paper outer ply requires a relatively longer scaling time to form the transverse end seals than an all plastic film material. Flow wrap equipment utilizing conventional rotary sealing heads may lack sufficient contact time with the film to transfer sufficient heat through the outer lamination to adequately melt the heat seal layers and produce an airtight seal. Similar problems may be seen with laminations comprising a non-paper outer ply where the outer ply is relatively thick or has high thermal resistance or where the heat sealing range or window is very narrow. Flow wrap equipment having long dwell sealing heads is known in the art to increase the dwell time. However, such equipment requires cam arrangements which allow the heat seal head to translate in the machine direction at the same speed as the film to extend the heating dwell time. Such systems include D-cam profile, box motion profile, oval cam profile, and so forth. While such systems provide increased heat sealing capabilities due to their ability to extend the length of time that the heat seal heads are in contact with the film, such systems also increase the complexity, cost, and footprint of the equipment.

It would be desirable to provide improved film structures having a paper component or other thermally resistant component that can be used for flow wrap applications utilizing rotary sealing heads while also providing high integrity heat seals.

SUMMARY

In one aspect, a web of sheet material is provided which can be wrapped around a product to form a pack. The sheet material comprises a sealant ply laminated to an outer ply. The sealant ply has a first major surface and a second major surface opposite the first major surface, the first major surface comprising a heat sealable material. The outer ply has a third major surface and a fourth major surface opposite the third major surface, wherein the third major surface faces the second major surface. The web of sheet material comprises a plurality of connected blanks, each blank comprising a plurality of cutouts removing a portion of the outer ply, wherein the cutouts are aligned with overlapping portions of transverse heat seal regions of the sheet material.

In a further aspect, a method of forming a pack is provided.

Advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
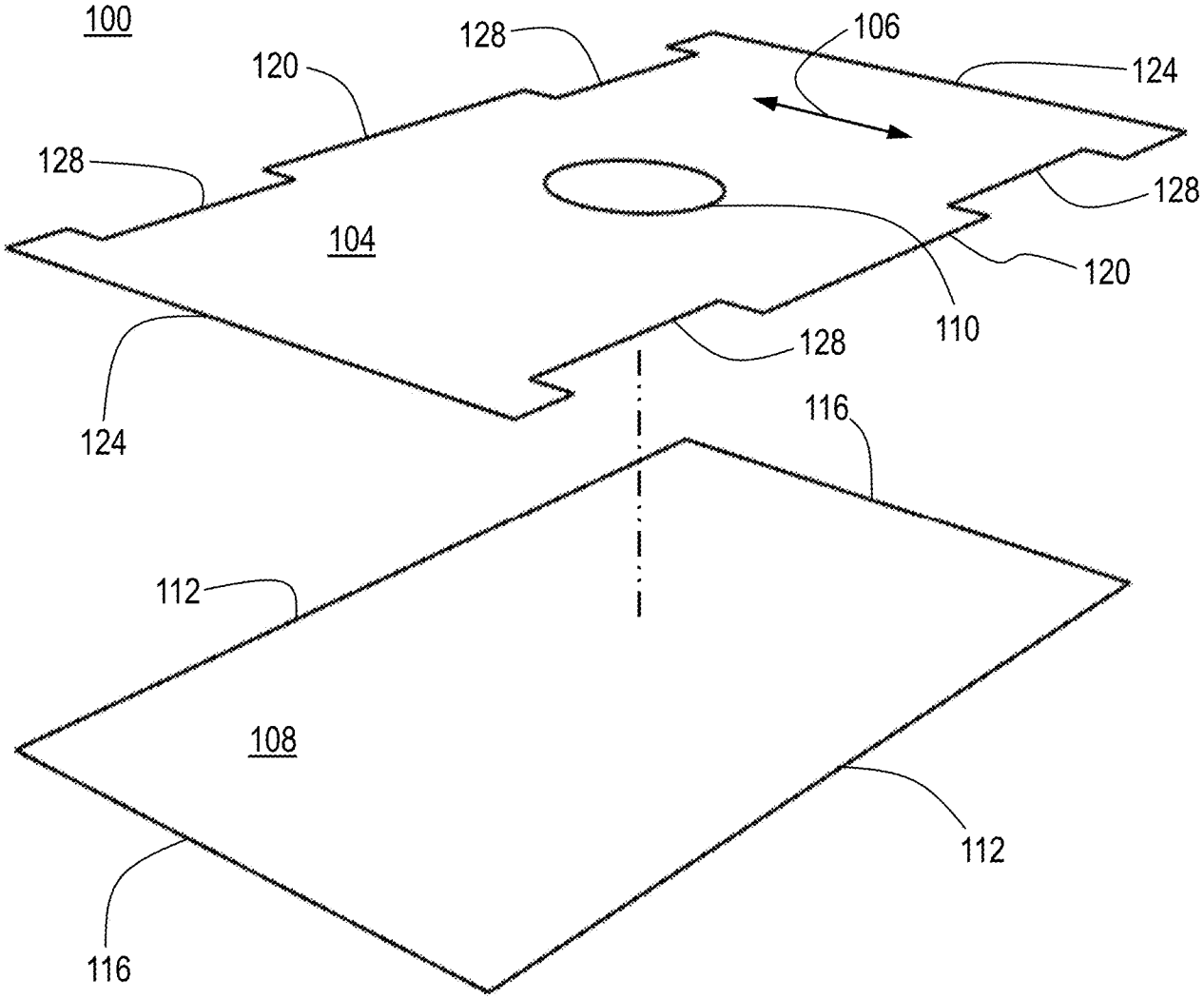
FIG. 1 is an exploded view of an exemplary blank for producing a pack in accordance with the present disclosure.

Reference will now be made in detail to presently preferred embodiments of the invention, one or more examples of which are illustrated in the accompanying drawings. Each example is provided by way of explanation of the invention, not limitation of the invention, which may be embodied in various forms. Therefore, specific structural and functional details disclosed herein are not to be interpreted as limiting but merely as a basis for the claims and as a representative basis for teaching one skilled in the art to variously employ the present inventive concept in virtually any appropriately detailed structure. Further, the terms and phrases used herein are not intended to be limiting but rather to provide an understandable description of the present development. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention cover such modifications and variations as come within the scope of the appended claims and their equivalents.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected.

As used in this application, the terms "front," "rear," "upper," "lower," "upwardly," "downwardly," "left," "right," and other orientation descriptors are intended to facilitate the description of the exemplary embodiments of the present invention, and are not intended to limit the structure thereof to any particular position or orientation. The term "longitudinal" as used herein refers to a direction parallel to a machine direction as indicated by arrows in the drawings, unless specifically stated otherwise. The term "transverse" as used herein refers to a direction orthogonal to the machine direction, unless specifically stated otherwise.

The term "outer" in reference to a ply, layer, surface, etc., refers to an orientation toward the exterior of a package (i.e., away from the packaged product) when the film is used as a packaging film. The term "inner" in reference to a ply, layer, surface, etc., refers to an orientation toward the interior of a package (i.e., toward the packaged product) when the film is used as a packaging film. The terms "medial" and "lateral" as used herein refer to a position that is closer to or further away from a longitudinal center line 154 (see, e.g., FIG. 2) in the transverse direction, unless specifically stated otherwise.

All numbers herein are assumed to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5).

Referring now to the drawings, FIG. 1 is an exploded isometric view of a laminated sheet material, designated generally as 100, in accordance with the present disclosure. The structure 100 includes an outer ply 104 laminated to a sealant ply 108. The sealant ply 108 has a first major surface which comprises a heat sealable material and forms an innermost surface of the structure, i.e., the surface which is in closest proximity to the contents of a pack formed of the sheet material 100. The sealant ply 108 has a second major surface opposite the sealant ply 108 first major surface. The sealant ply 108 includes transversely spaced apart, longitudinally extending edges 116 and longitudinally spaced apart, transversely extending edges 112.

The outer ply 104 has a first major surface and a second major surface opposite the first major surface, wherein the outer ply first major surface faces toward the sealant ply second major surface. The outer ply second major surface forms an outer surface of a pack formed of the sheet materials 100. The outer ply 104 includes transversely spaced apart, longitudinally extending edges 124 and longitudinally spaced apart, transversely extending edges 120.

An optional opening or window 110 may be formed in the outer ply 104. For example, when the outer ply is formed of paper or other opaque material, the optional window 110 may be provided to allow consumers to visualize the contents 174 (see FIGS. 32 and 33) through the underlying sealant ply 108. In certain embodiments, the optional window 110 may be provided and positioned to intersect with a perforation pattern formed in the sealant ply 108. Although a generally circular window 110 is depicted, it will be recognized that the optional window 110 may be of any desired size or geometric shape.

FIG. 1 depicts a single unit 100 for forming a pack for case of illustration; however, as best seen in FIGS. 5, 11, 17, and 23, it will be recognized that the sheet material herein will comprise a continuous elongate web comprising a plurality of connected blanks 100 extending in the machine direction as indicated by the arrow 106.

Figure 2:
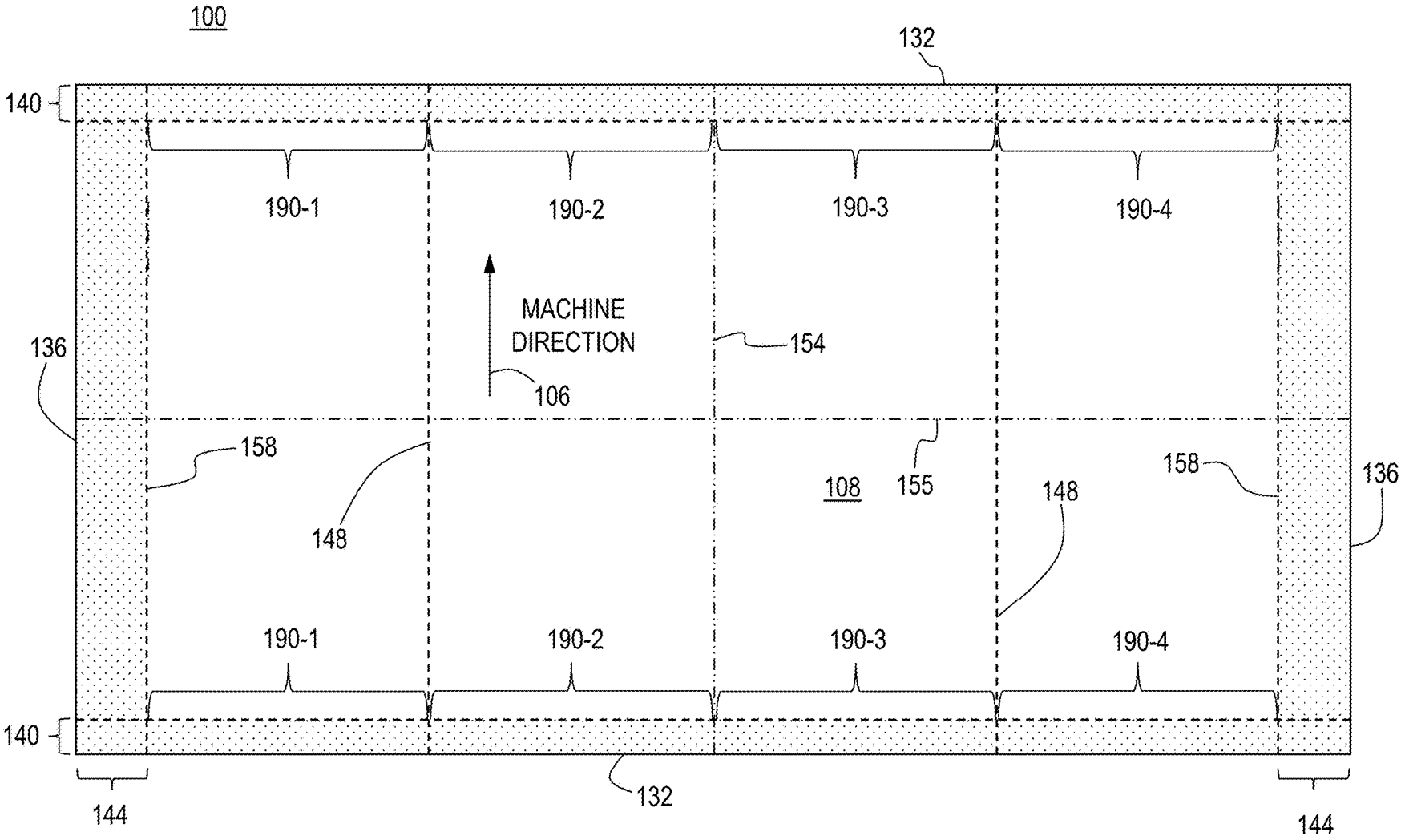
FIG. 2 is a bottom plan view of the blank appearing in FIG. 1, illustrating the first, second, third, and fourth portions of each of the first and second transverse sealing regions.

FIG. 2 is a bottom plan view of a blank 100 showing the sealing layer 108. The blank 100 has first and second longitudinally extending scaling regions 144 spaced apart from each other in the transverse direction on opposite sides of a longitudinal centerline 154. During a packaging operation, the sealing surfaces of the longitudinally extending sealing regions 144 are brought together and sealed to form a longitudinal fin seal 146 (see, e.g., FIG. 6).

The blank 100 further includes first and second transversely extending scaling regions 140 spaced apart from each other in the machine direction on opposite sides of a transverse centerline 155. During a packaging operation, the blank 100 is folded along a first and second fold lines 148 when the first and second longitudinally edges 136 are brought together.

The first fold line 148 extends in the machine direction and is disposed intermediate the medial edge line 158 of the first longitudinally extending scaling region 144 and the axial centerline 154. In certain embodiments, the first fold line 148 is disposed midway between the medial edge line 158 of the first longitudinally extending sealing region 144 and the axial center line 154.

The second fold line 148 extends in the machine direction and is disposed intermediate the medial edge line 158 of the second longitudinally extending sealing region 144 and the axial centerline 154. In certain embodiments, the second fold line 148 is disposed midway between the medial edge line 158 of the second longitudinally extending sealing region 144 and the axial center line 154.

As best seen in FIG. 2, each of the first and second transversely extending scaling regions 140 are divided into four portions, namely a first portion 190-1 extending between the medial edge line 158 of the first longitudinal sealing region 144 and the first fold line 148; a second portion 190-2 extending between the first fold line 148 and the longitudinal center line 154; a third portion 190-3 extending between the longitudinal center line 154 and the second fold line 148; and a fourth portion 190-4 extending between the second fold line 148 and the medial edge line 158 of the second longitudinal scaling region 144.

Figure 3:
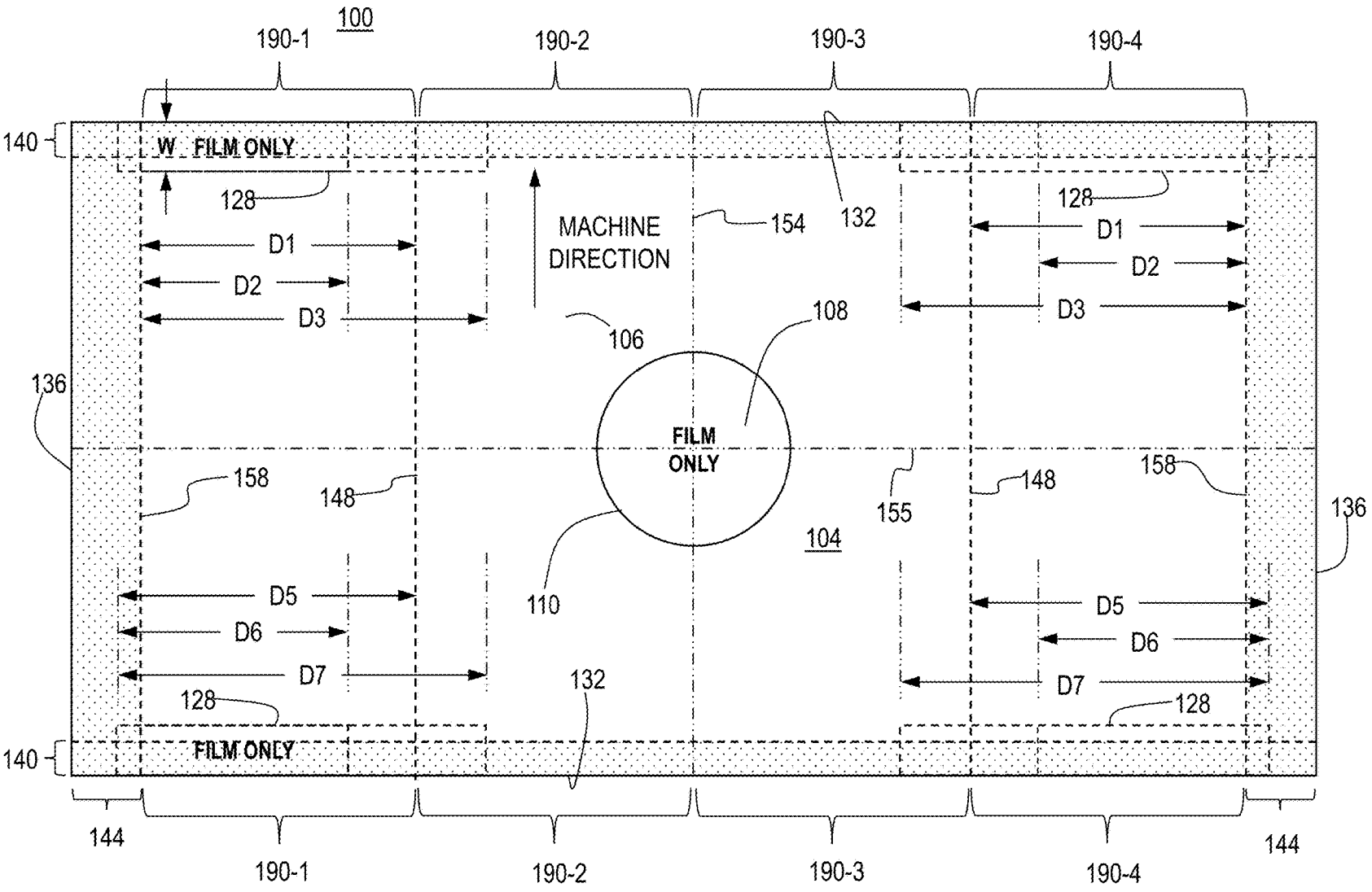
FIG. 3 is a top plan view of the blank appearing in FIG. 1.
Figure 6:
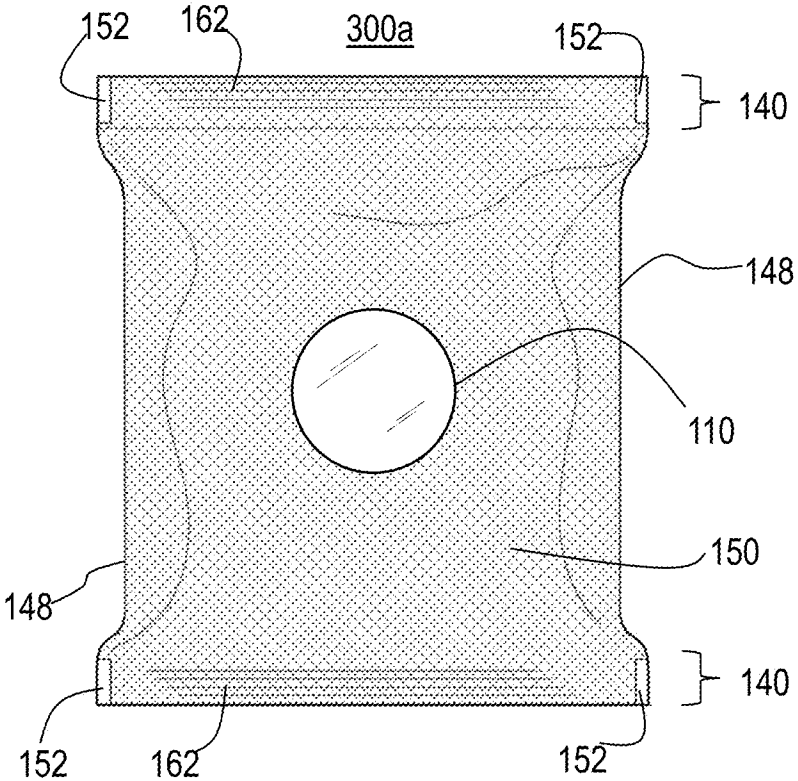
FIG. 6 is front view of the first embodiment pack formed from the first embodiment blank appearing in FIG. 4.

During a packaging operation, the first portion 190-1 of each transverse sealing region 140 is sealed to the second portion 190-2 of the respective transverse sealing region 140 and the third portion 190-3 of each transverse sealing region 140 is sealed to the fourth portion 190-4 of the respective transverse sealing region 140 to form the leading and trailing end seals 162 (see, e.g., FIG. 6). As best seen in FIG. 3, a first one of the notches 128 at least partially overlies or overlaps with the first portion 190-1 of the first transverse scaling region 140; a second one of the notches 128 at least partially overlies or overlaps with the fourth portion 190-4 of the first transverse scaling region 140; a third one of the notches 128 at least partially overlies or overlaps with the first portion 190-1 of the second transverse scaling region 140; and a fourth one of the notches 128 at least partially overlies or overlaps with the fourth portion 190-4 of the second transverse scaling region 140.

In certain embodiments, the extent W of the notches in the machine direction is greater than or equal to the width of the scaling region 140. In certain embodiments, for typical package sizes contemplated hereunder, the extent W of the notches in the machine direction is in the range of 6 to 26 mm, and more preferably in the range of 9 to 13 mm.

The extent, e.g., D1, D2, or D3 of the notches 128 in the transverse direction may be less than, equal to, or greater than the transverse width of the respective heat seal portion 190-1 or 190-4. In preferred embodiments, the notches are all of equal dimensions and are symmetrically disposed with respect to the centerline 154, In certain embodiments, the notches 128 extend in the transverse direction from the medial edge line 158 of the adjacent heat seal region 144 to the adjacent fold line 148 and have a transverse dimension of D1, which is equal to the transverse dimension of the corresponding first or fourth heat seal portion 190-1 or 190-4, as applicable.

In certain embodiments, the notches 128 extend in the transverse direction from the medial edge line 158 of the adjacent heat seal region 144 a portion of the distance to the adjacent fold line 148 and have a transverse dimension of D2. In embodiments, the ratio of D2/D1 is in the range of 0.75 to 0.99. In embodiments, the ratio of D2/D1 is in the range of 0.80 to 0.95. In embodiments, the ratio of D2/D1 is in the range of 0.85 to 0.90. In certain embodiments, for typical package sizes contemplated hereunder, D1-D2 is in the range of from about 1-13 mm.

In certain embodiments, the notches 128 extend in the transverse direction from the medial edge line 158 of the adjacent heat seal region 144 beyond the adjacent fold line 148 and have a transverse dimension of D3. In embodiments, the ratio D3/D1 is in the range of 1.01 to 1.25. In embodiments, D3/D1 is in the range of 1.05 to 1.20. In embodiments, D3/D1 is in the range of 1.10 to 1.15. In certain embodiments, for typical package sizes contemplated hereunder, D3-D1 is in the range of from about 1-13 mm.

In certain embodiments, the notches 128 extend in the transverse direction from a point intermediate the lateral edge 136 and the medial edge line 158 of the adjacent heat seal region 144 to the adjacent fold line 148 and have a transverse dimension of D5, where D5-D1 represents the distance the notch 128 extends into the adjacent heat seal region 144. In embodiments, D5-D1 is equal to 1 to 50% of the transverse dimension of the adjacent heat seal region 144. In certain embodiments, D5-D1 is equal to 5 to 45% of the transverse dimension of the adjacent heat seal region 144. In certain embodiments, D5-D1 is equal to 10 to 40% of the transverse dimension of the adjacent heat seal region 144. In certain embodiments, D5-D1 is equal to 15 to 35% of the transverse dimension of the adjacent heat seal region 144. In certain embodiments, D5-D1 is equal to 15 to 35% of the transverse dimension of the adjacent heat seal region 144. In certain embodiments, D5-D1 is equal to 20 to 30% of the transverse dimension of the adjacent heat seal region 144. In certain embodiments, D5-D1 is equal to 25% of the transverse dimension of the adjacent heat seal region 144.

In certain embodiments, the notches 128 extend in the transverse direction from a point intermediate the lateral edge 136 and the medial edge line 158 of the adjacent heat seal region 144 a portion of the distance to the adjacent fold line 148 and have a transverse dimension of D6, where D6-D2 represents the distance the notch 128 extends into the adjacent heat seal region 144. In embodiments, D6-D2 is equal to 1 to 50% of the transverse dimension of the adjacent heat seal region 144. In certain embodiments, D6-D2 is equal to 5 to 45% of the transverse dimension of the adjacent heat seal region 144. In certain embodiments, D6-D2 is equal to 10 to 40% of the transverse dimension of the adjacent heat seal region 144. In certain embodiments, D6-D2 is equal to 15 to 35% of the transverse dimension of the adjacent heat seal region 144. In certain embodiments, D6-D2 is equal to 15 to 35% of the transverse dimension of the adjacent heat seal region 144. In certain embodiments, D6-D2 is equal to 20 to 30% of the transverse dimension of the adjacent heat seal region 144. In certain embodiments, D6-D2 is equal to 25% of the transverse dimension of the adjacent heat seal region 144.

In certain embodiments, the notches 128 extend in the transverse direction from a point intermediate the lateral edge 136 and the medial edge line 158 of the adjacent heat seal region 144 beyond the adjacent fold line 148 and have a transverse dimension of D7, where D7-D3 represents the distance the notch 128 extends into the adjacent heat seal region 144. In embodiments, D7-D3 is equal to 1 to 50% of the transverse dimension of the adjacent heat seal region 144. In certain embodiments, D7-D3 is equal to 5 to 45% of the transverse dimension of the adjacent heat seal region 144. In certain embodiments, D7-D3 is equal to 10 to 40% of the transverse dimension of the adjacent heat seal region 144. In certain embodiments, D7-D3 is equal to 15 to 35% of the transverse dimension of the adjacent heat seal region 144. In certain embodiments, D7-D3 is equal to 15 to 35% of the transverse dimension of the adjacent heat seal region 144. In certain embodiments, D7-D3 is equal to 20 to 30% of the transverse dimension of the adjacent heat seal region 144. In certain embodiments, D7-D3 is equal to 25% of the transverse dimension of the adjacent heat seal region 144.

In certain embodiments, the sealant ply 108 comprises one or more active agents such as anti-fogging agents, oxygen absorbers, moisture absorbers, or antimicrobial/antibacterial agents that are effective to provide a desired property to a surface of the sealant ply. In embodiments, the one or more active agents are provided to convey the desired property or properties to the inward facing surface of the sealant ply 108, i.e., the surface that faces or contacts the product.

In certain embodiments, the active agent may be provided in the form of a coating applied onto the heat-scalable layer. Conventional techniques can be used for the application of the active agent to the heat-scalable layer, such as gravure coating, reverse kiss coating, blade coating, knife over roll coating, fountain bar coating, spray coating, slot coating, and others. In embodiments, the amount of active agent coating is in the range of from 0.1 to 10 $g/m^2$, or from 0.5 to 8 $g/m^2$, or from 1 to 5 $g/m^2$. The application of the active agent coating may be carried out either by an in-line method involving application during the manufacture of the film 100 or by an off-line coating method involving application after the manufacture of the film 100.

Alternatively, one or more active agents may be compounded directly into the polymer resin of the heat-scalable layer before extrusion of the heat seal layer of the sealant ply 108. In embodiments, the amount of active agent added to the heat-scalable layer is generally from 0.25 to 10%, or from 0.5% to 8%, or from 1 to 3%, by weight, of the heat-scalable layer.

Suitable anti-fogging agents for use as the active agent include but are not limited to non-ionic surfactants such as polyhydric alcohol fatty acid esters, higher fatty acid amines, higher fatty acid amides, polyoxyethylene ethers of higher fatty alcohols, and ethylene oxide adducts of higher fatty acid amines or amides, non-ionic fluorinated surfactants, such as alkylester fluorides, perfluoroalkyl ethylene oxides, anionic fluorinated surfactants, such as quaternary ammonium salt of perfluoroalkyl sulfonates, and the like.

The antimicrobial agent may be substantially any appropriate antimicrobial composition useful for the intended purpose of inhibiting the growth of microbes, such as bacteria, fungi, viruses, or protozoa. In embodiments, the antimicrobial agent may be selected from inorganic metal based or organic antimicrobial agents or the like, although it will be recognized that the antimicrobial agent may other antimicrobial agents as known in the art, including antibiotics, antiseptics, antiviral agents, antifungal agents, and disinfectants. In certain embodiments, the antimicrobial agent is selected from silver nanoparticles, silver nitrate.

Suitable moisture absorbing agents include nitrate salts, disodium phosphate, calcium chloride, potassium carbonate, and others.

Suitable antioxidants include vitamin E (tocopherol), ascorbic acid (vitamin C), butylated hydroxyanisole (BHA), butylated hydroxytoluene (BHT), propyl gallate, and others.

Suitable oxygen absorbers include potassium sulfite, sodium sulfite: ascorbic acid, ferrous sulfate: Ferrous sulfate is a chemical compound that can act as an oxygen absorber. It reacts with oxygen to form ferric sulfate, tannins, and activated carbon.

In certain embodiments, the sealant ply 108 further comprises a metallization layer. In embodiments, the metallization layer is formed is aluminum. In embodiments, the metallization layer is on an outward facing surface of the sealant ply 108. In embodiments, the metallization layer is formed via a deposition process on the sealant ply 108 such as sputter deposition (including magnetron or ion beam sputter deposition), thermal evaporation physical vapor deposition, and chemical vapor deposition.

Referring now to FIGS. 4-9, there appears a first exemplary embodiment packaging blank 100*a*, which may be embodied as an elongate web 200*a* of connected blanks 100*a* which extend in the machine direction, and which can be folded around an item or product 174 (see FIGS. 32 and 33) and scaled to form a pack 300*a*. Exemplary products suitable for use with the packaging material 100 include food, pharmaceutical, industrial, and other products. The web 200*a* may advantageously be used in conjunction with flow wrap equipment (e.g., horizontal flow wrap equipment) utilizing a rotary sealing head, however, it will be understood that it is not limited to such. The film structures in accordance provide increased packaging speed with high seal integrity and/or the ability to maintain high seal integrity with reduced scaling temperature.

The blank 100*a* includes a first longitudinal edge 136 extending in a machine direction and a second longitudinal edge 136 extending in the machine direction, wherein the first longitudinal edge 136 is opposite the second longitudinal edge 136. A first transverse edge 132 extends in a transverse direction perpendicular to the longitudinal edges 136. A second transverse edge 132 extends in the transverse direction, wherein the second transverse edge 132 is spaced apart from the first transverse edge 132 in the machine direction 106. A longitudinally extending hidden region 138 represents the region of the back panel 300*a* which is beneath the fin seal 146.

A first longitudinal heat seal region 144 extends along the first longitudinal edge 136 from the first transverse edge 132 to the second transverse edge 132. A second longitudinal heat seal region 144 extends along the second longitudinal edge 136 from the first transverse edge 132 to the second transverse edge 132. The first longitudinal heat seal region 144 is heat scalable to the second longitudinal heat seal region 144 to form a longitudinal heat seal 146, which runs the longitudinal length of the finished pack 300*a*. In the illustrated embodiment, the longitudinal heat seal 146 is a fin seal formed wherein the first major surface of the sealant ply is sealed to itself in the first and second longitudinal heat seal regions 144. In alternative embodiments (not shown), the fin seal 146 may be replaced with a lap seal in cases where the second major surface of the outer ply 104 comprises a heat sealable material.

A first longitudinal fold line 148 extends in the machine direction from the first transverse edge 132 to the second transverse edge 132. The first longitudinal fold line 148 is disposed intermediate a longitudinal center axis 154 and the first longitudinal edge 136. A second longitudinal fold line 148 extends from the first transverse edge 132 to the second transverse edge 132, the second longitudinal fold line 148 being disposed intermediate the longitudinal center axis 154 and the second longitudinal edge 136. An optional longitudinally extending region 142 may be provided comprising a pattern of perforations formed in the sealant ply 108. In the illustrated embodiment, the optional perforated region 142 is transversely coaligned with the centerline 154 although it will be recognized that other perforation patterns are contemplated. A transverse centerline 155 bisects the blank 100*a* in the transverse direction.

A first transverse heat seal region 140 extends along the first transverse edge 132 from the first longitudinal edge 136 to the second longitudinal edge 136. A first portion 190-1 of the first transverse heat seal region 140 is configured to form a heat seal with a second portion 190-2 of the first transverse heat seal region 140 wherein the first portion 190-1 of the first transverse heat seal region 140 faces or overlies the second portion 190-2 of the first transverse heat seal region 140 when the blank 100*a* is folded along the first longitudinal fold line 148. A third portion 190-3 of the first transverse heat seal region 140 is configured to form a heat seal with a fourth portion 190-4 of the first transverse heat seal region 140, wherein the third portion 190-3 of the first transverse heat seal 140 region faces or overlies the fourth portion 190-4 of the first transverse heat seal region when the blank is folded along the second longitudinal fold line 148.

In embodiments, the first portion 190-1 of the first transverse heat seal region 140 extends between a medial edge 158 of the first longitudinal heat seal region 144 and the first longitudinal fold line 148; the second portion 190-2 of the first transverse heat seal region 140 extends between the first longitudinal fold line 148 and the axial center line 154; the third portion 190-3 of the first transverse heat seal region 140 extends between the axial center line 154 and the second longitudinal fold line 148; and the fourth portion 190-4 of the first transverse heat seal region 140 extends between the second longitudinal fold line 148 and a medial edge 158 of the second longitudinal heat seal region 144.

A second transverse heat seal region 140 extends along the second transverse edge 132 from the first longitudinal edge 136 to the second longitudinal edge 136, wherein a first portion 190-1 of the second transverse heat seal region 140 is configured to form a heat seal with a second portion 190-2 of the second transverse heat seal region 140, wherein the first portion 190-1 of the second transverse heat seal region faces the second portion 190-2 of the second transverse heat seal region when the blank 100*a* is folded along the first longitudinal fold line 148, and wherein a third portion 190-3 of the second transverse heat seal region 140 is configured to form a heat seal with a fourth portion 190-4 of the second transverse heat seal region 140, wherein the third portion 190-3 of the first transverse heat seal region 140 faces the fourth portion 190-4 of the first transverse heat seal region 140 when the blank is folded along the second longitudinal fold line 148.

In embodiments, the first portion 190-1 of the second transverse heat seal region 140 extends between a medial edge 158 of the first longitudinal heat seal region 144 and the first longitudinal fold line 148; the second portion 190-2 of the second transverse heat seal region 140 extends between the first longitudinal fold line 148 and the axial center line 154; the third portion 190-3 of the second transverse heat seal region 140 extends between the axial center line 154 and the second longitudinal fold line 148; and the fourth portion 190-4 of the second transverse heat seal region 140 extends between the second longitudinal fold line 148 and a medial edge 158 of the second longitudinal heat seal region 144.

A first cutout 128 is formed in the outer ply 104 and removes a portion of the outer ply 104 along the first transverse edge 120. The first cutout 128 is at least partially overlapping with the first portion 190-1 of the first transverse heat seal region 140. A second cutout 128 is formed in the outer ply 104 and removes a portion of the outer ply 104 along the first transverse edge 120. The second cutout 128 is at least partially overlapping with the fourth portion 190-4 of the first transverse heat seal region 140.

A third cutout 128 is formed in the outer ply 104 and removes a portion of outer ply 104 along the second transverse edge 120. The third cutout 128 is at least partially aligned with the first portion 190-1 of the second transverse heat seal region 140. A fourth cutout 128 is formed in the outer ply 104 and removes a portion of the outer ply 104 along the second transverse edge 120. The fourth cutout 128 is at least partially overlapping with the fourth portion 190-4 of the second transverse heat seal region 140.

By forming the notches 128 to remove the outer ply material along portions of the transverse heat seal regions 140, the thermal resistivity of the outer ply 104 is removed in the region of the notches 128 such that the sealant material of the sealant ply 108 may soften and seal at lower dwell times than if the notches 128 were not present, thereby making the film structures herein advantageous for use with flow wrap equipment utilizing a rotary sealing head to provide greater seal integrity, increased packaging speed, or both. The notches 128 may also advantageously allow the sealant material of the sealant ply 108 to soften and seal at a lower sealing temperature than if the notches 128 in the outer ply 104 were not present.

In certain embodiments, the first and second cutouts 128 have a longitudinal extent in the machine direction which is greater than or equal to the longitudinal extent of the first transverse heat seal region 140, and the third and fourth cutouts 128 have a longitudinal extent in the machine direction which is greater than or equal to the longitudinal extent (seal width) of the second transverse heat seal region 140. As best seen in FIG. 3, the blank 100*a* illustrates first and second cutouts 128 having a longitudinal extent that is somewhat greater than the longitudinal extent of the first transverse heat seal region 140 and third and fourth cutouts 128 having a longitudinal extent that is somewhat greater than the longitudinal extent of the second transverse heat seal region 140.

In certain embodiments, the first and third cutouts 128 have a transverse extent which is greater than or equal to the transverse distance between the medial edge 158 of the first longitudinal heat seal region 144 and the first longitudinal fold line 148, and the second and fourth cutouts 128 have a transverse extent which is greater than or equal to the transverse distance between the medial edge 158 of the second longitudinal heat seal region 144 and the second longitudinal fold line 148.

Figure 4:
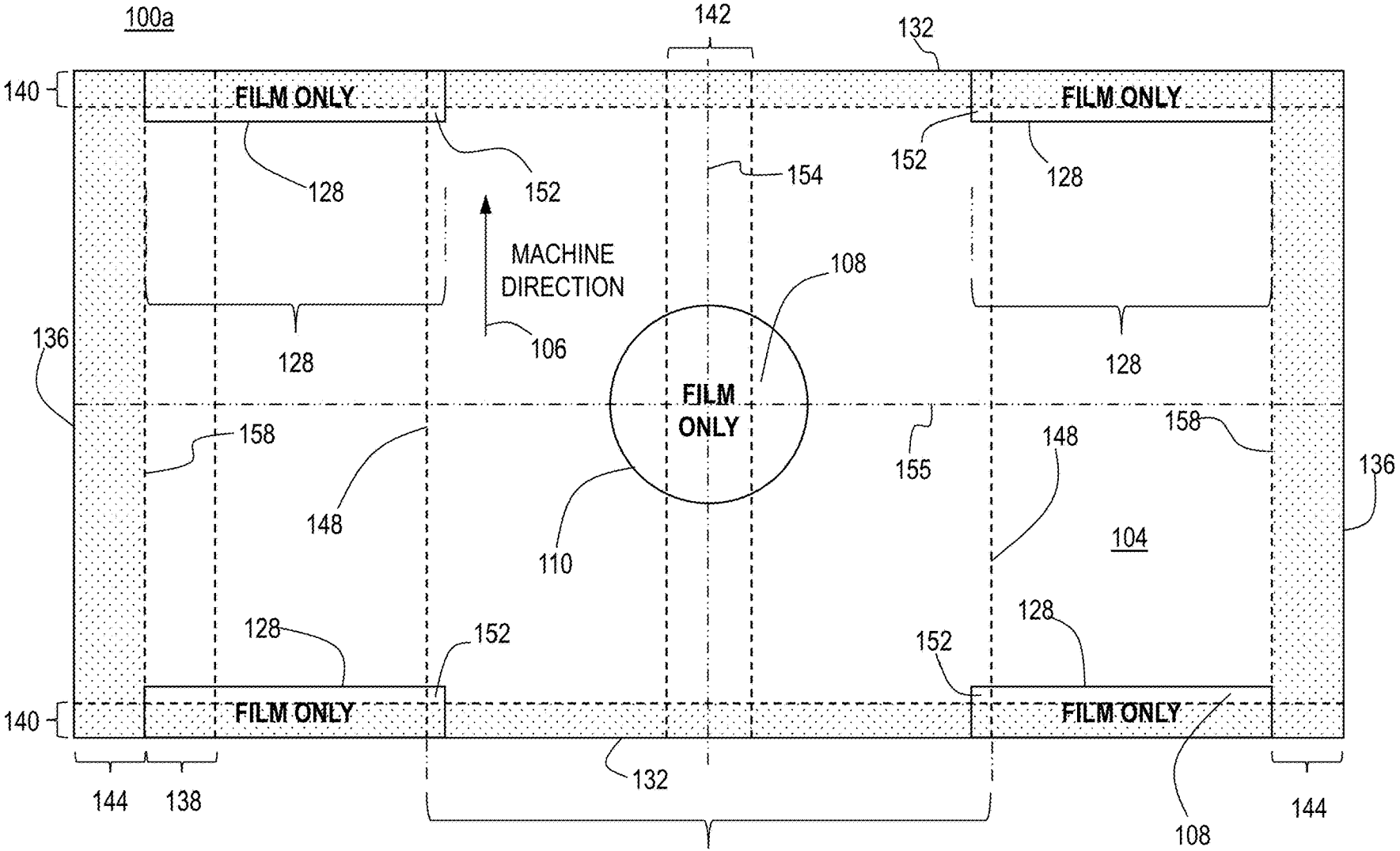
FIG. 4 is a top plan view of a first embodiment blank for producing a first embodiment pack in accordance with the present disclosure.
Figure 5:
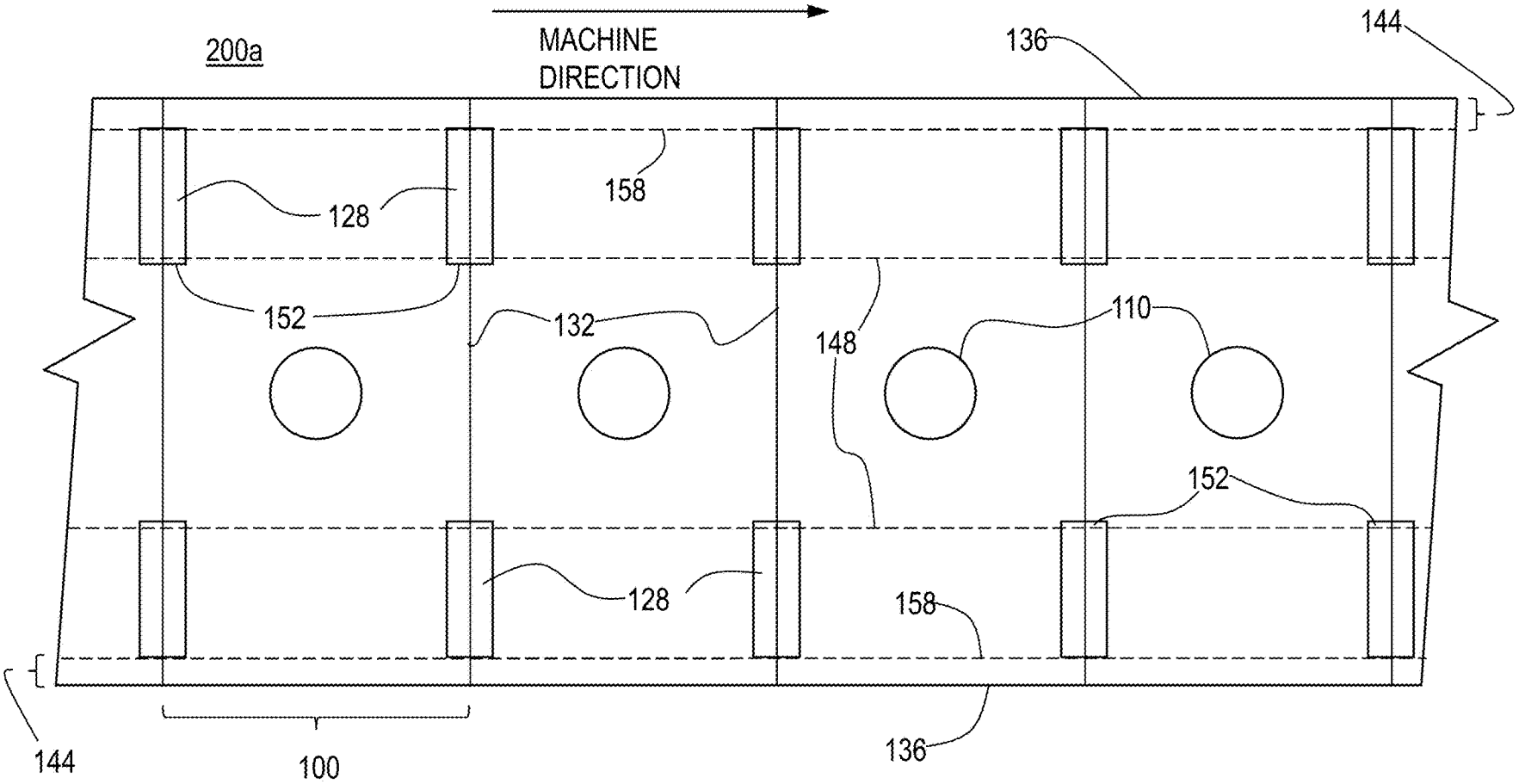
FIG. 5 is a top plan view of a sheet material comprising a continuous web of connected blanks of the type appearing in FIG. 4.
Figure 7:
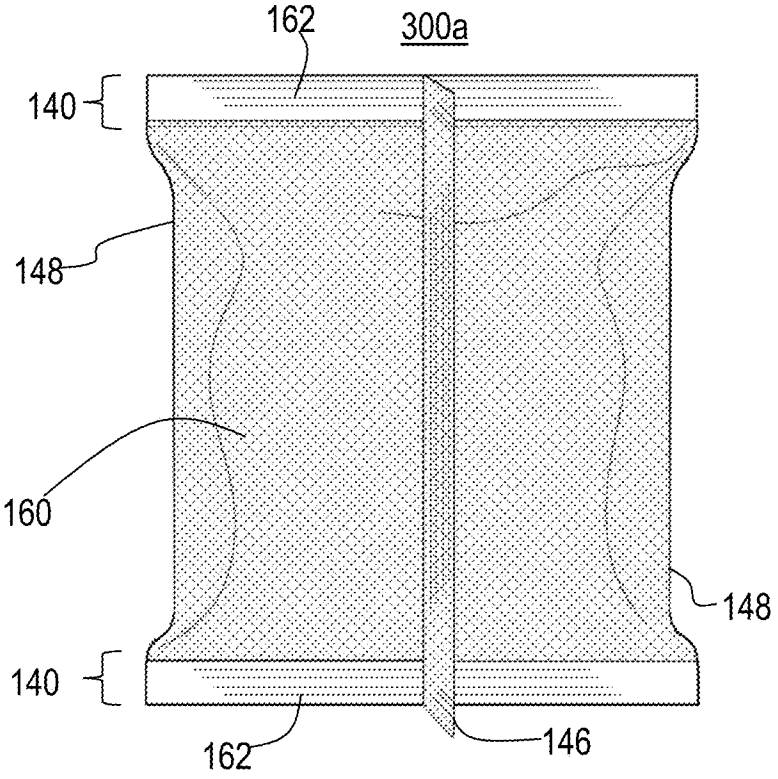
FIG. 7 is a rear view of the pack appearing in FIG. 6.

As best seen in FIG. 4, the blank 100*a* illustrates first and third cutouts 128 having a transverse extent that extends from the medial edge 158 of the first longitudinal heat seal region 144 to a transverse position that is intermediate the first fold line 148 and the axial center line 154, wherein a portion 152 of the first and third cutouts 128 extend beyond the first fold line 148 toward the centerline 154. The second and fourth cutouts 128 have a transverse extent that extends from the medial edge 158 of the second longitudinal heat seal region 144 to a transverse position that is intermediate the second fold line 148 and the axial center line 154, wherein a portion 152 of the second and fourth cutouts 128 extend beyond the second fold line 148 toward the center line 154. By removing the outer ply material in the notches 128 at a position that extends beyond the fold lines 148, heat seal efficiency is improved in the first and second transverse heat seal regions 140 at, and adjacent to, the first and second fold lines 148.

Figure 9:
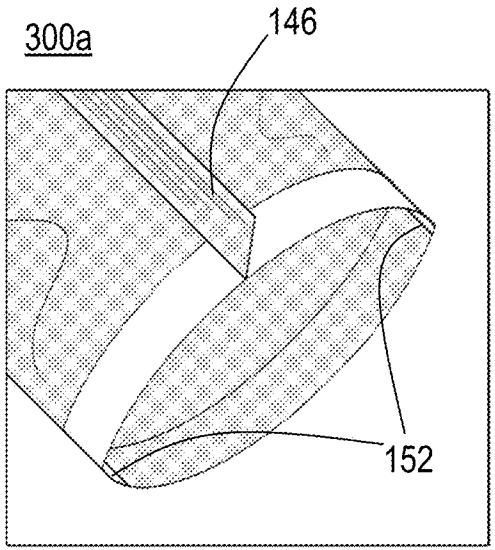
FIG. 9 is a fragmentary isometric view of the pack appearing in FIG. 6 with the end open.
Figure 8:
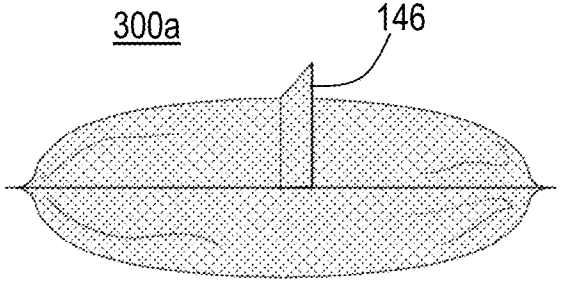
FIG. 8 is an end view of the pack appearing in FIG. 6.

Referring now to FIGS. 6-9, and with continued reference to FIGS. 1-5, there appears a pack 300*a* formed of the blank 100*a*. The blank 300*a* comprises the blank 100*a* which is folded generally around the long axis 154 to form a front panel 150, optionally with a window 110, a rear panel 160 opposite the front panel 150 with longitudinal fin seal 146, and opposing transverse end seals 162. As best seen in FIGS. 6 and 9, the portion 152 of each of the first, second, third, and fourth cutouts 128 wrap around the adjacent fold line 148 and onto the front of the pack 300*a*.

Referring now to FIGS. 10-15, there appears a second embodiment blank 100*b* and web 200*b* of connected blanks 100*b* which are used to form a second embodiment pack 300*b*. Except as otherwise specified, the above description of FIGS. 1-9 is equally applicable to FIGS. 10-15, which above description is incorporated here by reference.

Figure 10:
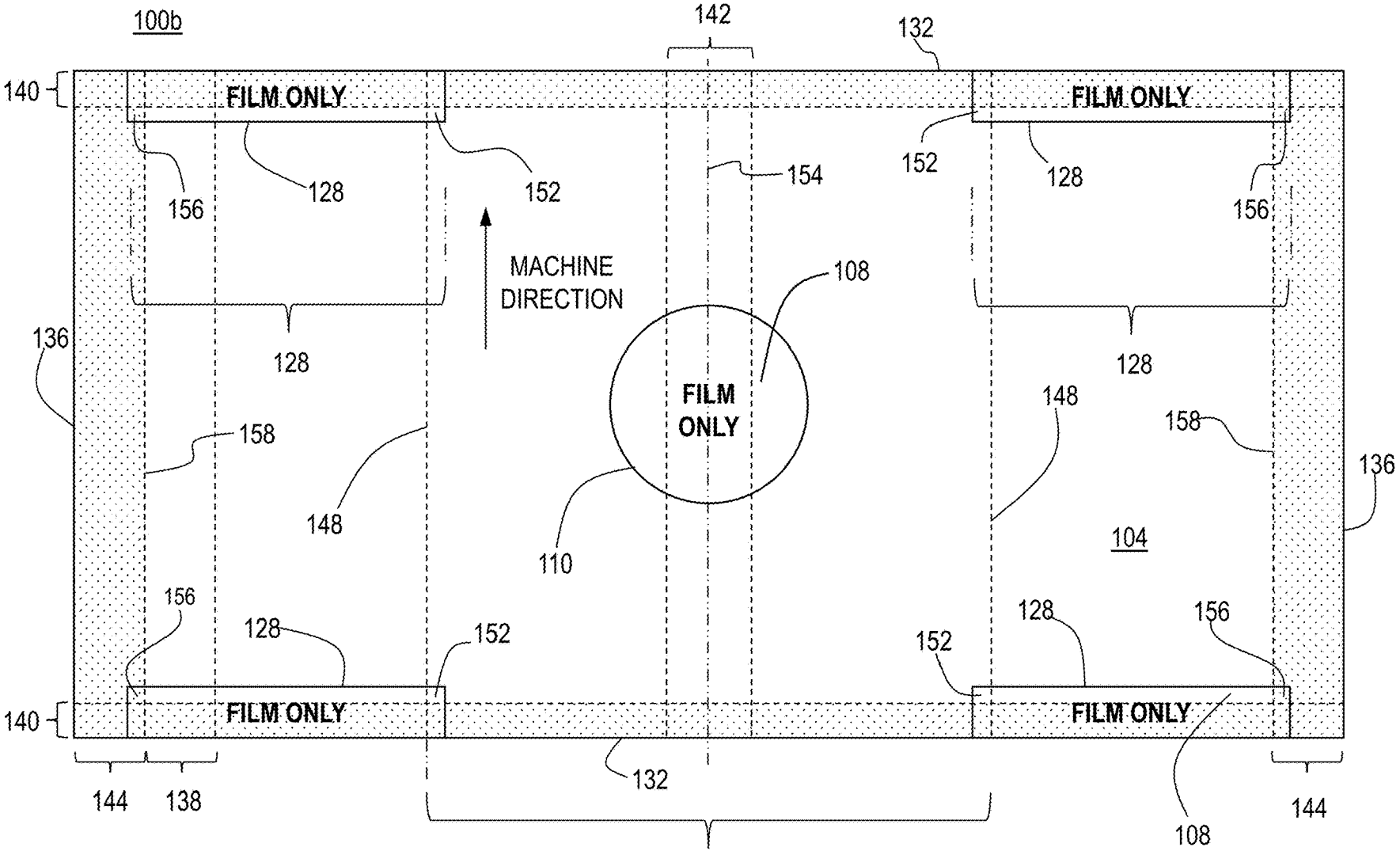
FIG. 10 is a top plan view of a second embodiment blank for producing a second embodiment pack in accordance with the present disclosure.
Figure 11:
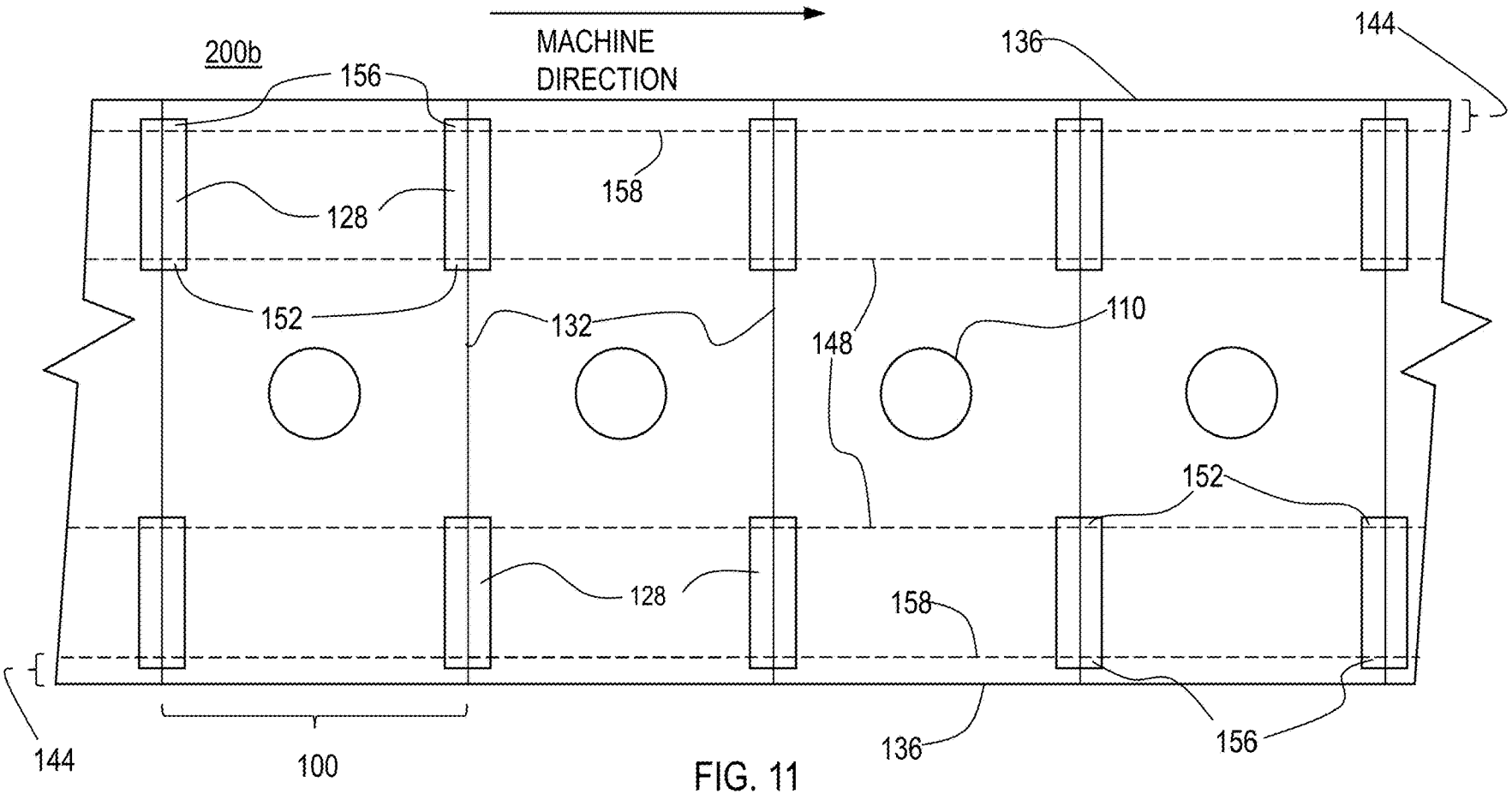
FIG. 11 is a top plan view of a sheet material comprising a continuous web of connected blanks of the type appearing in FIG. 10.
Figure 13:
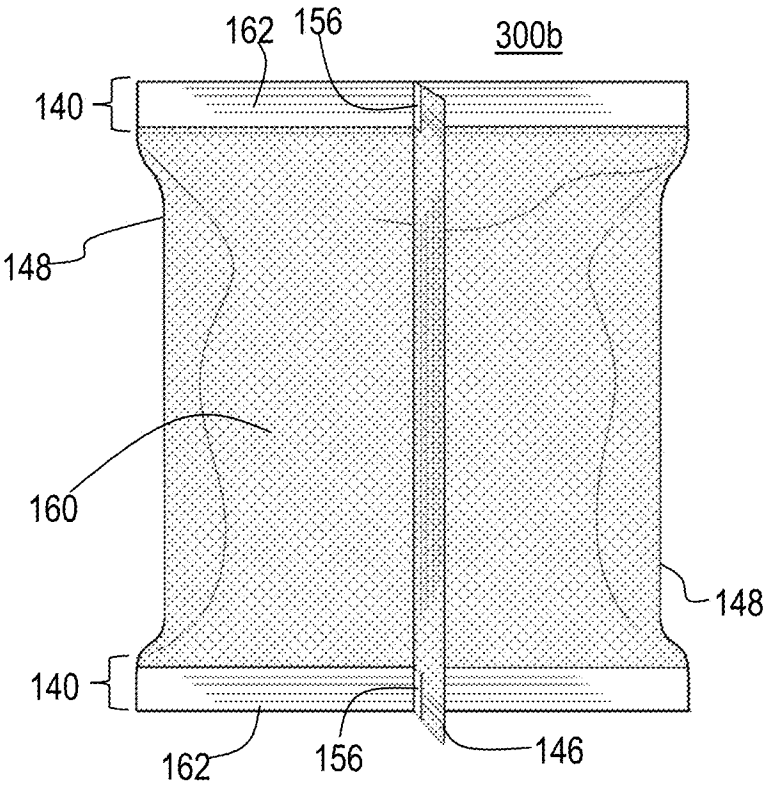
FIG. 13 is a rear view of the pack appearing in FIG. 12.

As best seen in FIG. 10, the blank 100*b* illustrates first and third cutouts 128 having a transverse extent that extends from a position intermediate the first longitudinal edge 136 and the medial edge 158 of the first longitudinal heat seal region 144 to a transverse position that is intermediate the first fold line 148 and the axial center line 154, wherein a portion 152 of the first and third cutouts 128 extend beyond the first fold line 148 toward the centerline 154, and further wherein a portion 156 of the first and third cutouts 128 extend beyond the medial edge line 158 of the first longitudinal heat seal region 144 toward the first longitudinal edge 136. The second and fourth cutouts 128 have a transverse extent that extends from a position intermediate the second longitudinal edge 136 and the medial edge 158 of the second longitudinal heat seal region 144 to a transverse position that is intermediate the second fold line 148 and the axial center line 154, wherein a portion 152 of the second and fourth cutouts 128 extend beyond the second fold line 148 toward the center line 154, and further wherein a portion 156 of the second and fourth cutouts 128 extend beyond the medial edge line 158 of the second longitudinal heat seal region 144 toward the second longitudinal edge 136. By removing the outer ply material at a position beyond the fold lines 148, heat seal efficiency is improved in the first and second transverse heat seal regions 140 at and adjacent to the first and second fold lines 148. By removing the outer ply material at a position beyond the medial edge lines 158 of the longitudinal heat seal regions 144, heat seal efficiency is improved in the first and second longitudinal heat seal regions 144 and adjacent to the transition between the fin seal 146 and the end seals.

Figure 12:
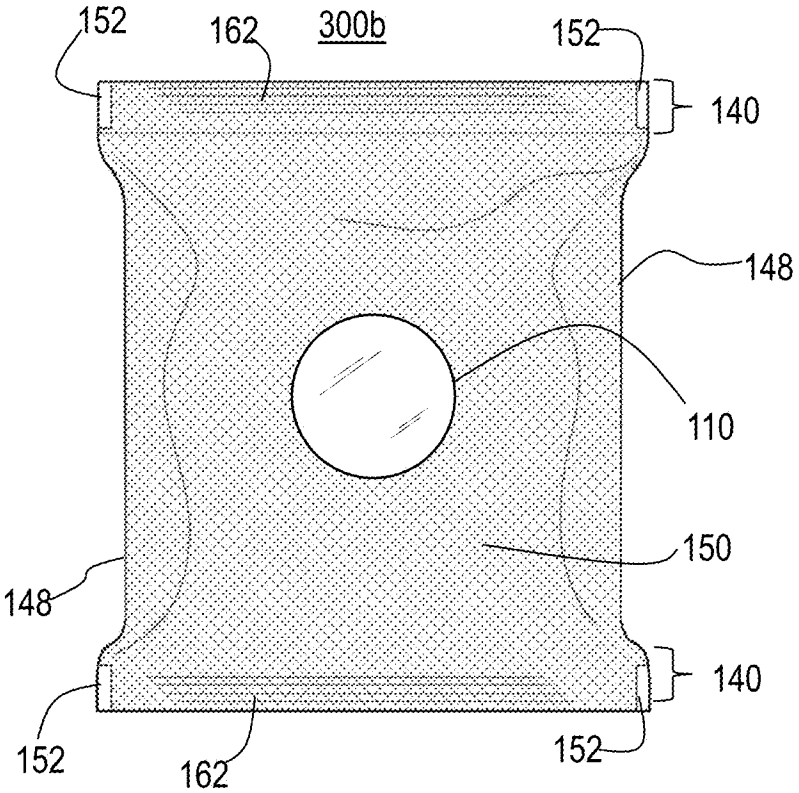
FIG. 12 is front view of the second embodiment pack formed from the second embodiment blank appearing in FIG. 10.
Figure 15:
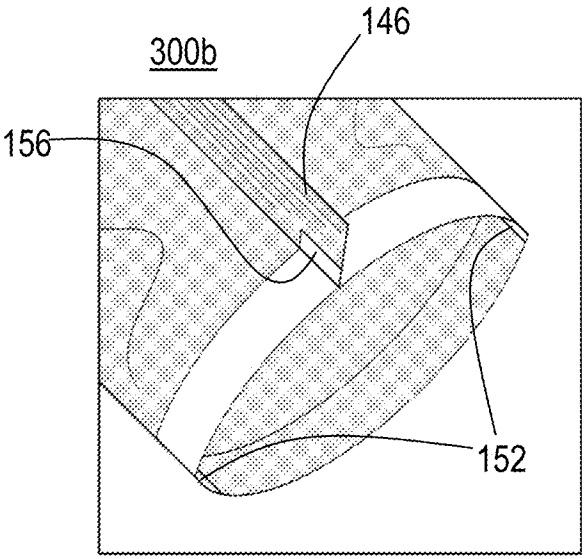
FIG. 15 is a fragmentary isometric view of the pack appearing in FIG. 12 with the end open.
Figure 14:
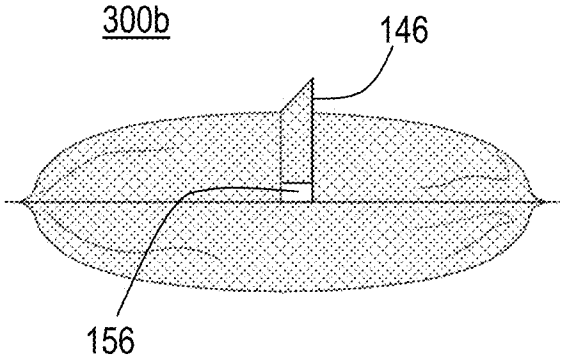
FIG. 14 is an end view of the pack appearing in FIG. 12.

Referring now to FIGS. 12-15, and with continued reference to FIGS. 1, 2, 3, 10, and 11, there appears a pack 300*b* formed of the blank 100*b*. The blank 300*b* comprises the blank 100*b* folded generally around the long axis 154 to form a front panel 150, optionally with a window 110, a rear panel 160 opposite the front panel 150 with longitudinal fin seal 146, and opposing transverse end seals 162. As best seen in FIGS. 12, 14, and 15, the portion 152 of each of the first, second, third, and fourth cutouts 128 wrap around the adjacent fold line 148 and onto the front of the pack 300*a* and the portion 156 of each of the first, second, third, and fourth cutouts 128 extend past the respective medial edge lines 158 and onto the longitudinal fin seal 146.

Referring now to FIGS. 16-21, there appears a third embodiment blank 100*c* and web 200*c* of connected blanks 100*c* which are used to form a third embodiment pack 300*c*. Except as otherwise specified, the above description of FIGS. 1-9 is equally applicable to FIGS. 16-21, which above description is incorporated here by reference.

Figure 16:
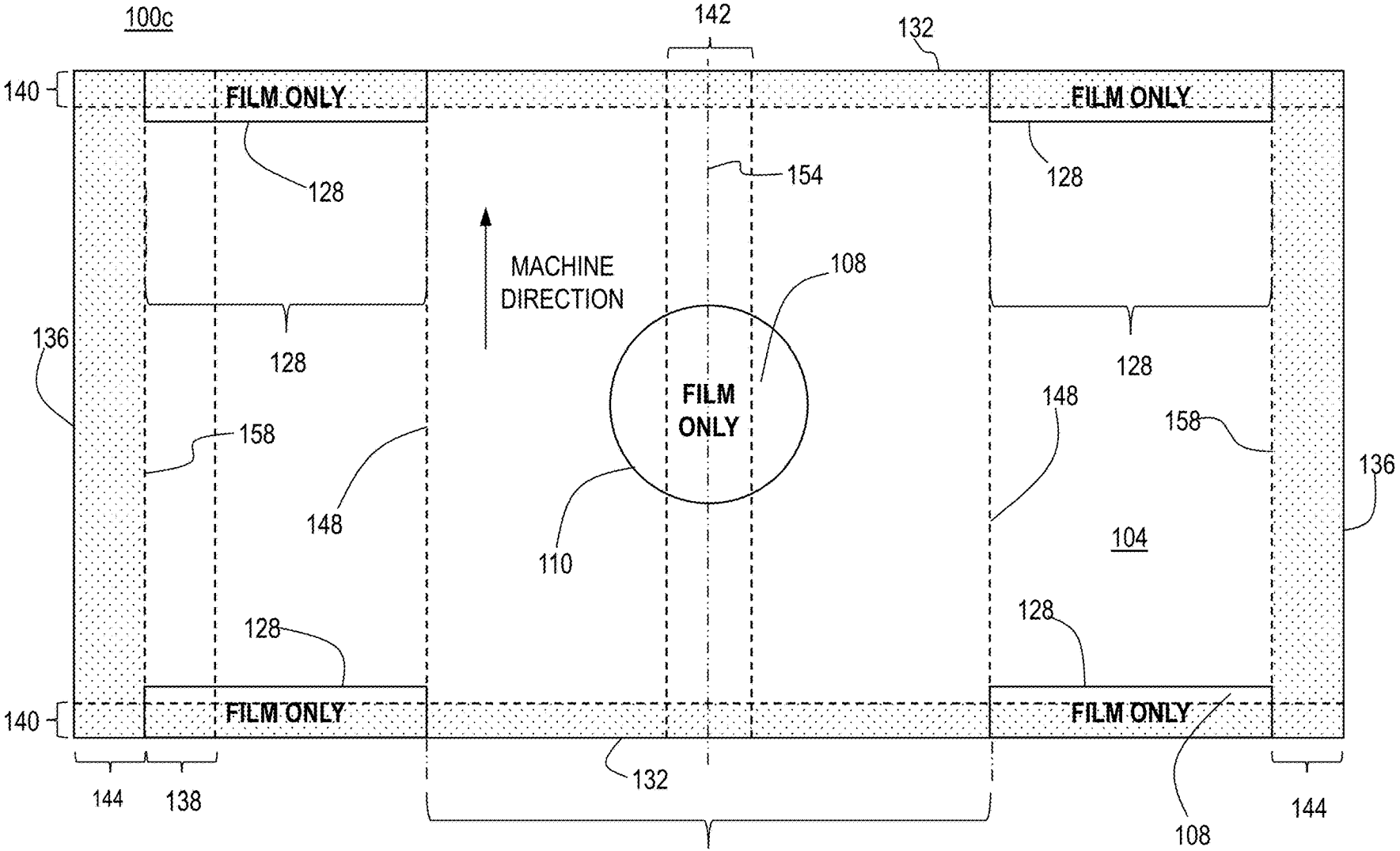
FIG. 16 is a top plan view of a third embodiment blank for producing a third embodiment pack in accordance with the present disclosure.
Figure 17:
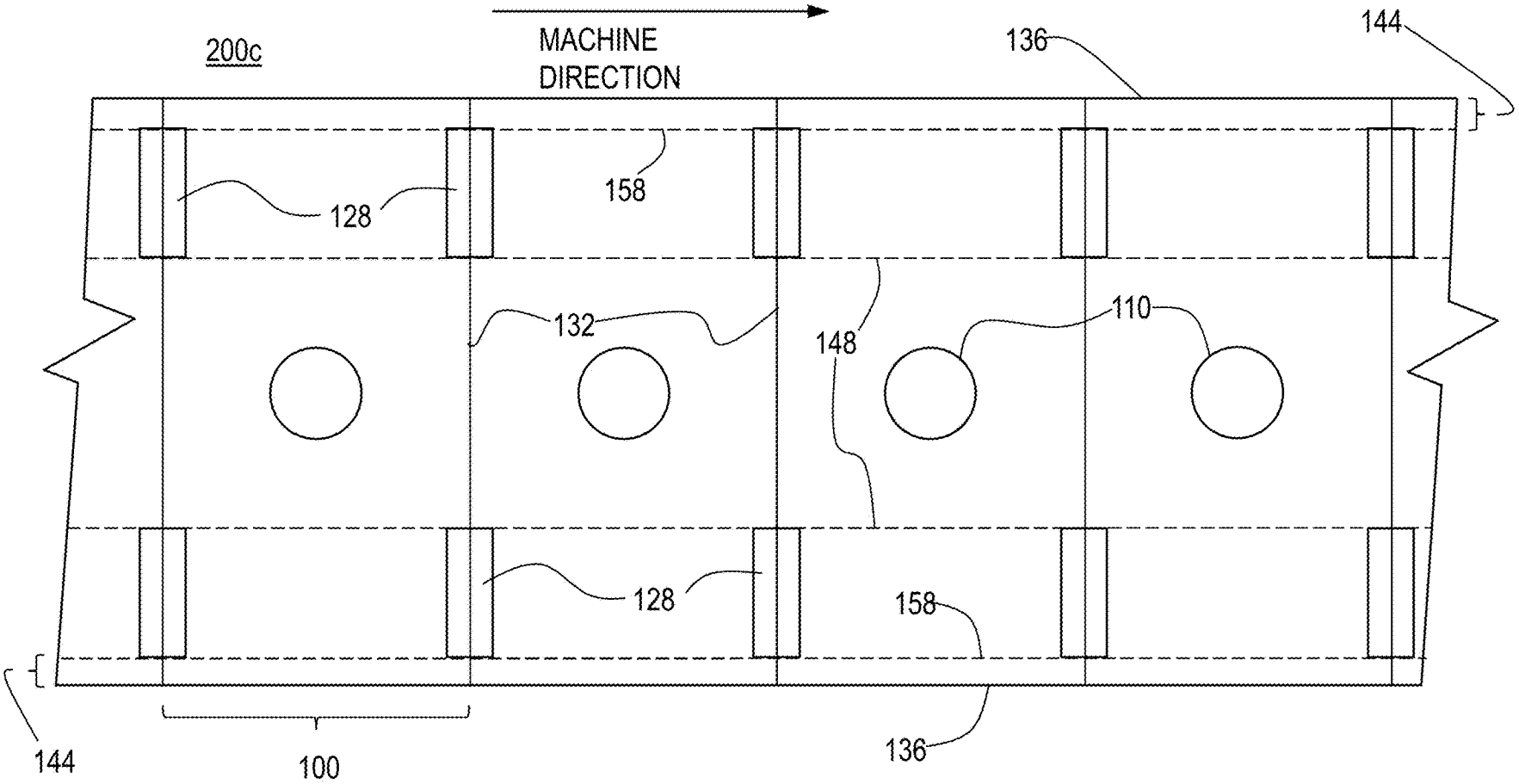
FIG. 17 is a top plan view of a sheet material comprising a continuous web of connected blanks of the type appearing in FIG. 16.
Figure 19:
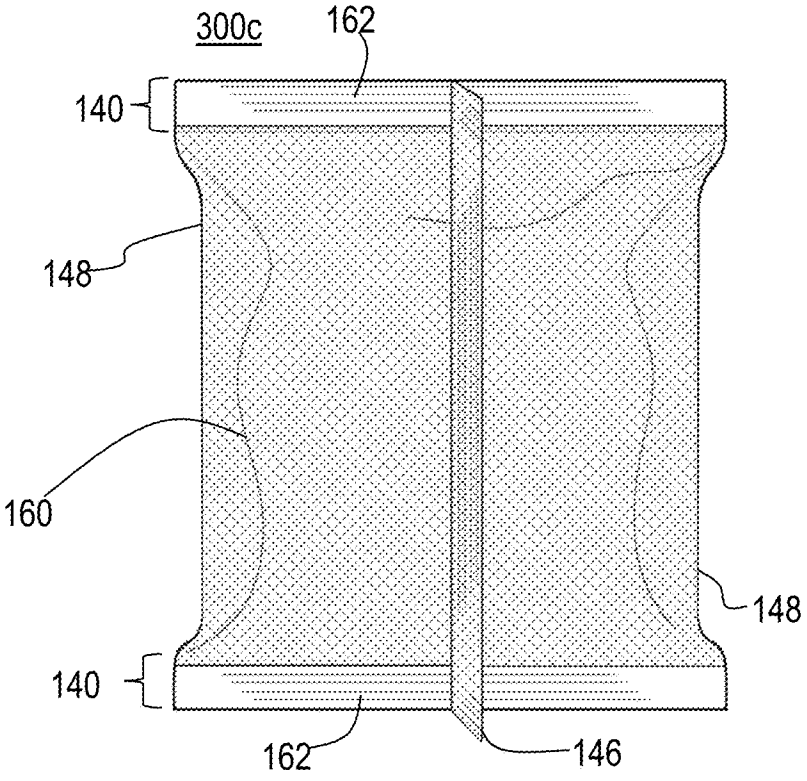
FIG. 19 is a rear view of the pack appearing in FIG. 18.
Figure 18:
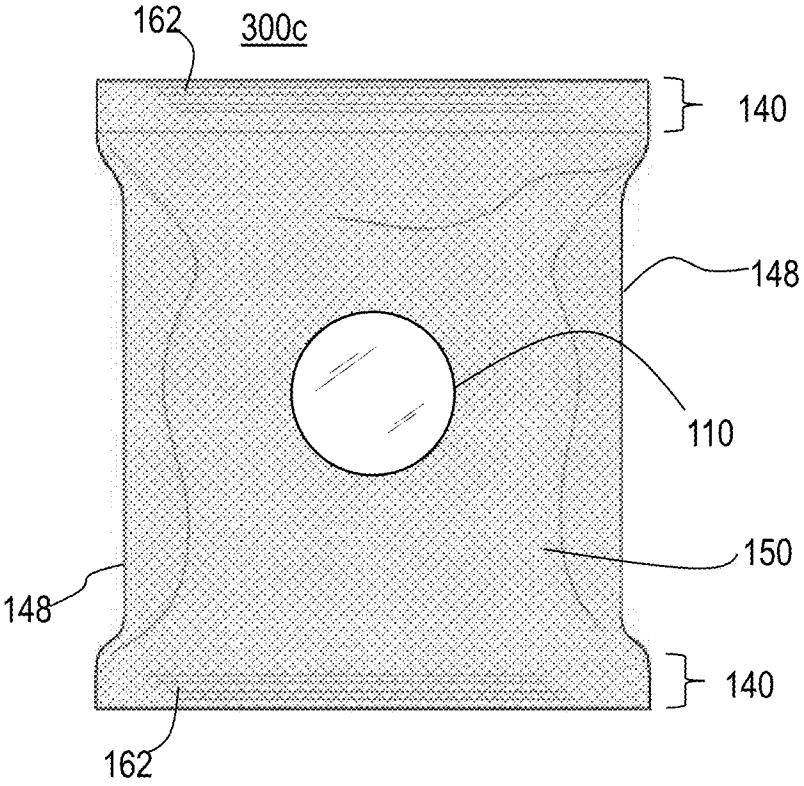
FIG. 18 is front view of the third embodiment pack formed from the third embodiment blank appearing in FIG. 16.
Figure 21:
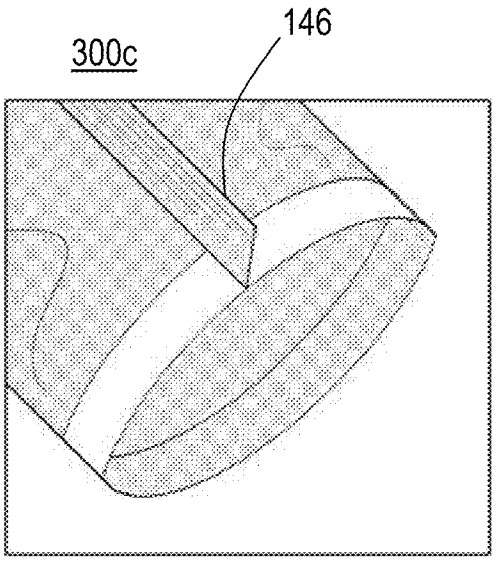
FIG. 21 is a fragmentary isometric view of the pack appearing in FIG. 18 with the end open.
Figure 20:
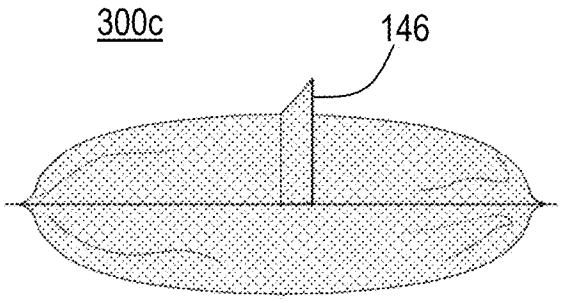
FIG. 20 is an end view of the pack appearing in FIG. 18.

As best seen in FIG. 16, the blank 100*c* illustrates first and third cutouts 128 having a transverse extent that extends from the medial edge 158 of the first longitudinal heat seal region 144 to the first fold line 148. The second and fourth cutouts 128 have a transverse extent that extends from the medial edge 158 of the second longitudinal heat seal region 144 to the second fold line 148.

Referring now to FIGS. 18-21, and with continued reference to FIGS. 1, 2, 16, and 17, there appears a pack 300*c* formed of the blank 100*c*. The blank 300*c* comprises the blank 100*c* folded generally around the long axis 154 to form a front panel 150, optionally with a window 110, a rear panel 160 opposite the front panel 150 with longitudinal fin seal 146, and opposing transverse end seals 162.

Referring now to FIGS. 22-27, there appears a fourth embodiment blank 100*d* and web 200*d* of connected blanks 100*d* which are used to form a fourth embodiment pack 300*d*. Except as otherwise specified, the above description of FIGS. 1-9 is equally applicable to FIGS. 22-27, which above description is incorporated here by reference.

Figure 22:
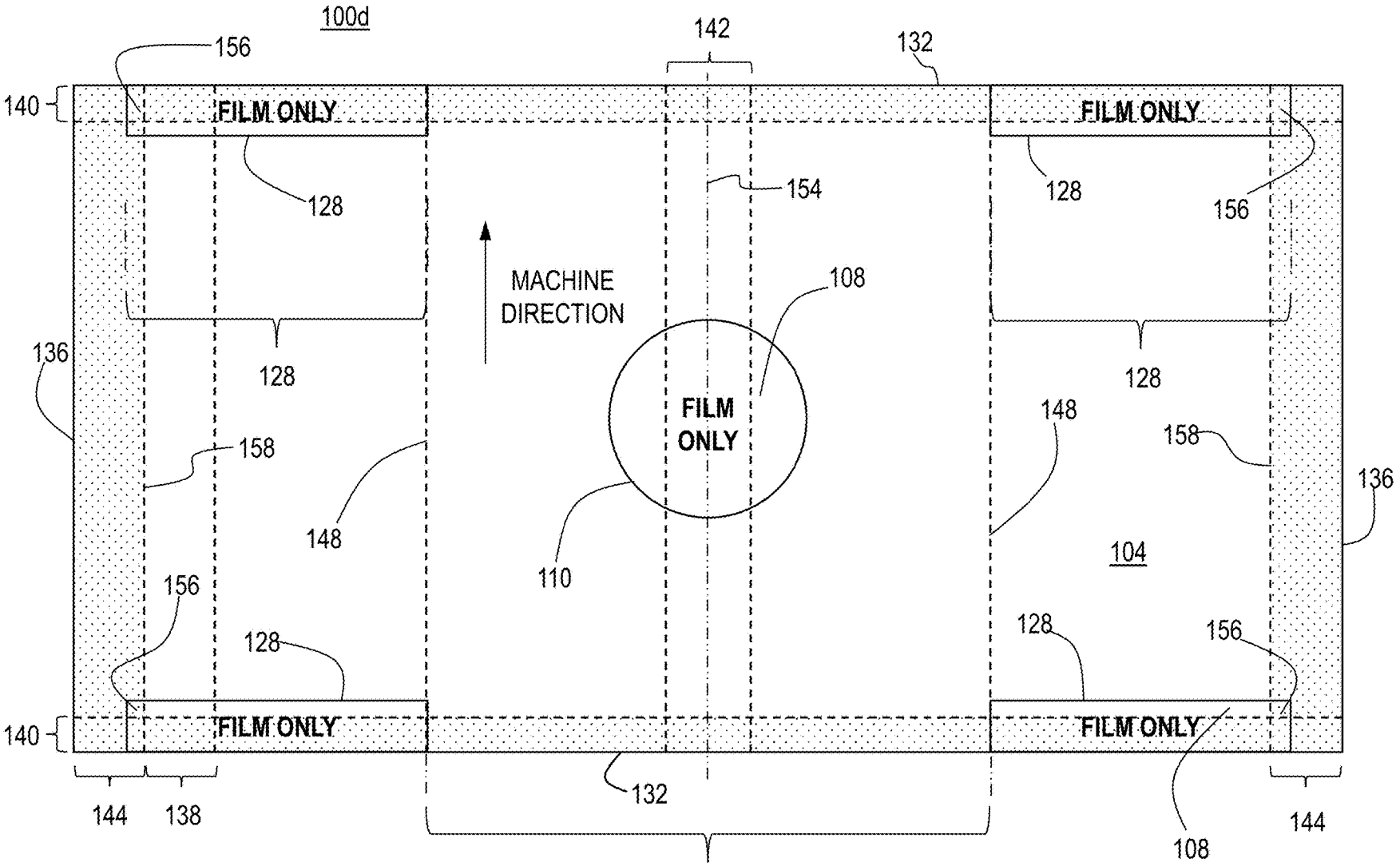
FIG. 22 is a top plan view of a fourth embodiment blank for producing a fourth embodiment pack in accordance with the present disclosure.
Figure 23:
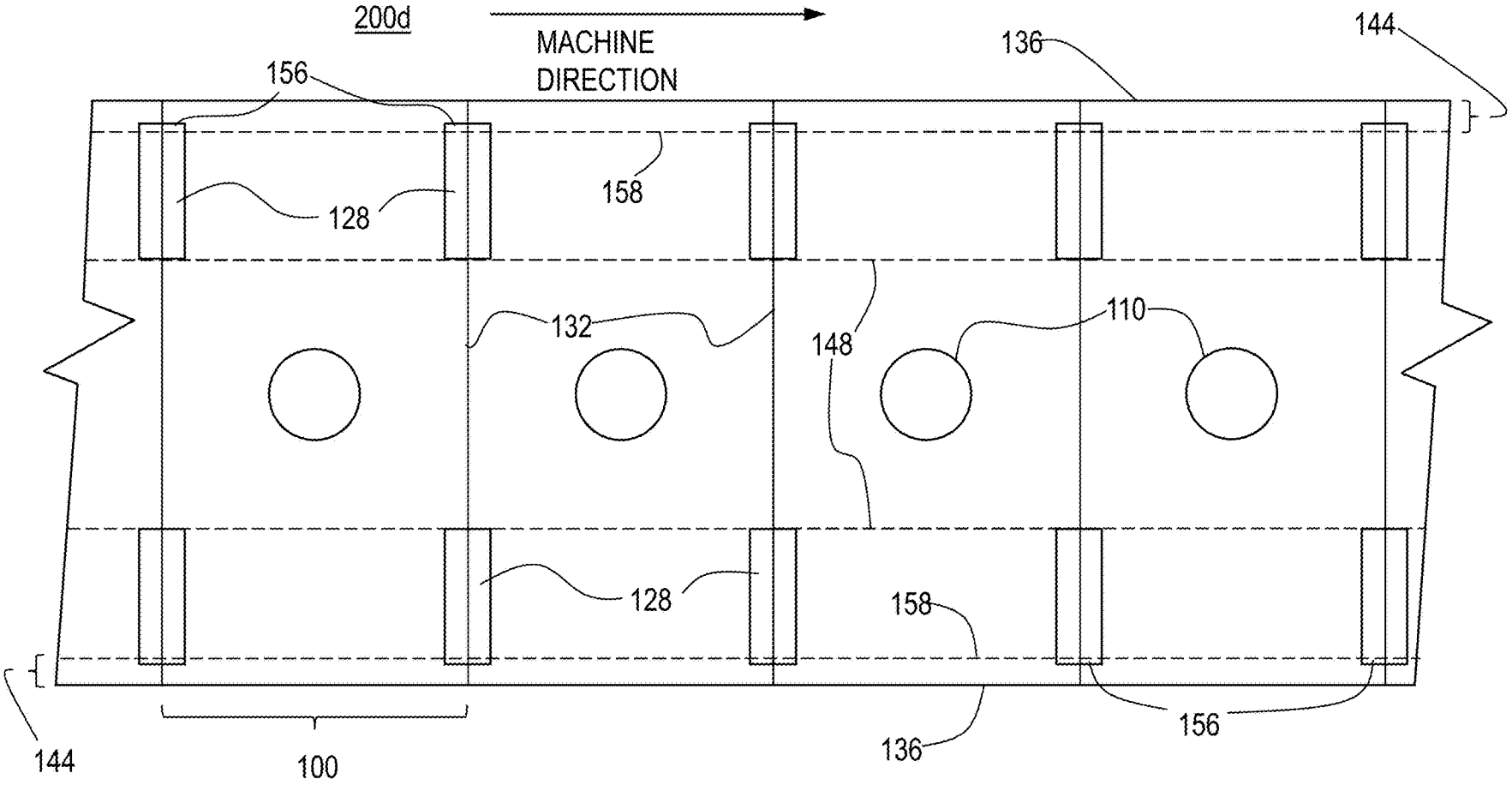
FIG. 23 is a top plan view of a sheet material comprising a continuous web of connected blanks of the type appearing in FIG. 22.

As best seen in FIG. 22, the blank 100*d* illustrates first and third cutouts 128 having a transverse extent that extends from a position intermediate the first longitudinal edge 136 and the medial edge 158 of the first longitudinal heat seal region 144 to the first fold line 148, wherein a portion 156 of the first and third cutouts 128 extend beyond the medial edge line 158 of the first longitudinal heat seal region 144 toward the first longitudinal edge 136. The second and fourth cutouts 128 have a transverse extent that extends from a position intermediate the second longitudinal edge 136 and the medial edge 158 of the second longitudinal heat seal region 144 to the second fold line 148, wherein a portion 156 of the second and fourth cutouts 128 extend beyond the medial edge line 158 of the second longitudinal heat seal region 144 toward the second longitudinal edge 136. By removing the outer ply material at a position beyond the medial edge lines 158 of the longitudinal heat seal regions 144, heat seal efficiency is improved in the first and second longitudinal heat seal regions 144 and adjacent to the transition between the fin seal 146 and the end seals.

Figure 25:
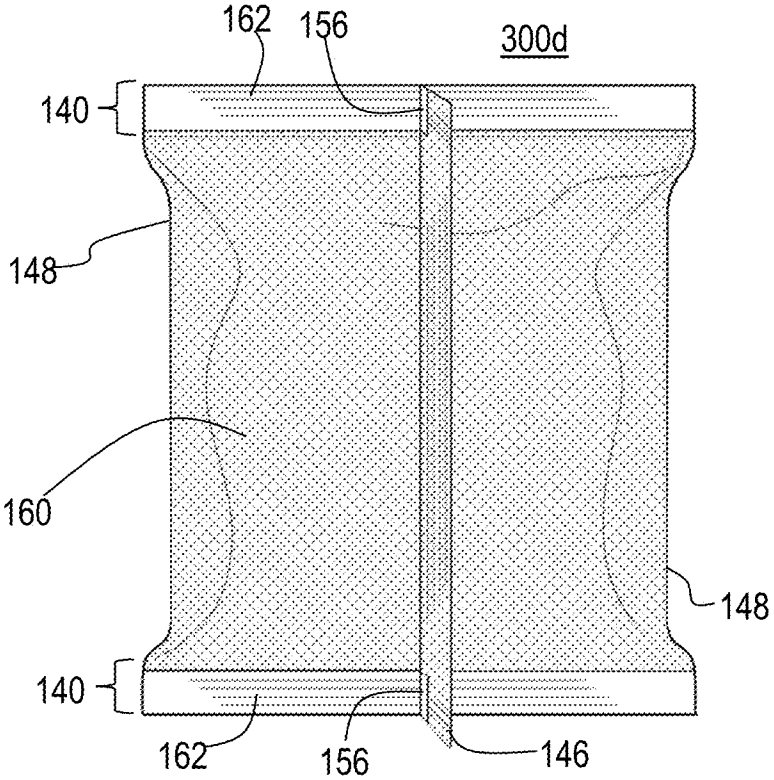
FIG. 25 is a rear view of the pack appearing in FIG. 24.
Figure 24:
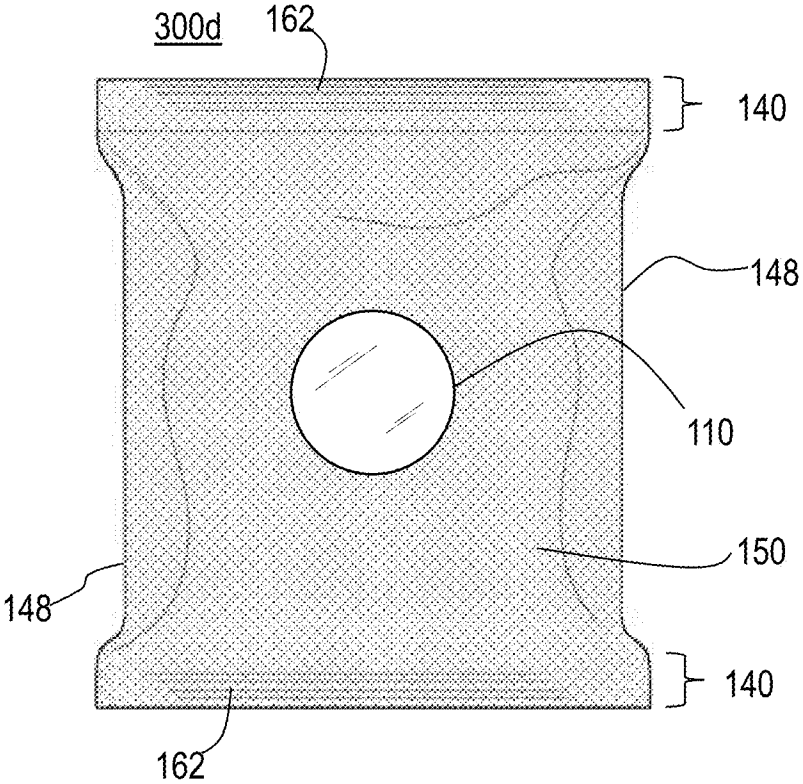
FIG. 24 is front view of the fourth embodiment pack formed from the fourth embodiment blank appearing in FIG. 22.
Figure 27:
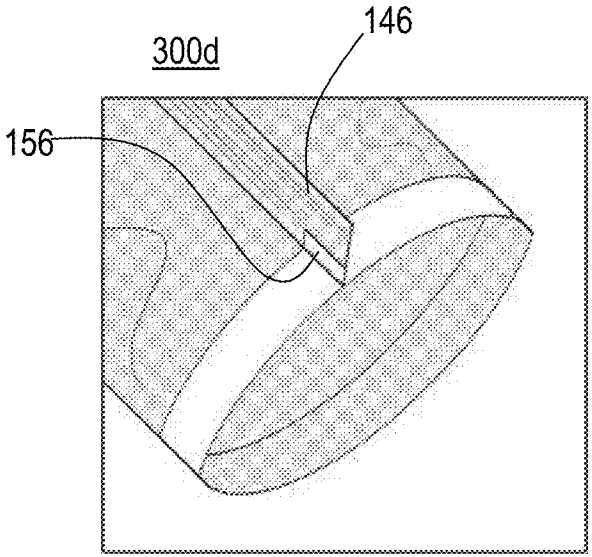
FIG. 27 is a fragmentary isometric view of the pack appearing in FIG. 24 with the end open.
Figure 26:
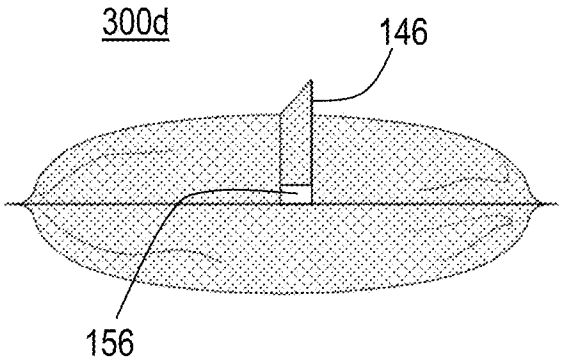
FIG. 26 is an end view of the pack appearing in FIG. 24.

Referring now to FIGS. 24-27, and with continued reference to FIGS. 1, 2, 22, and 23, there appears a pack 300*d* formed of the blank 100*d*. The blank 300*d* comprises the blank 100*d* folded generally around the long axis 154 to form a front panel 150, optionally with a window 110, a rear panel 160 opposite the front panel 150 with longitudinal fin seal 146, and opposing transverse end seals 162. As best seen in FIGS. 24-26, the portion 156 of each of the first, second, third, and fourth cutouts 128 extend past the medial edge lines 158 of the longitudinal fin seal adjacent fold line 148 and onto the longitudinal fin seal 146.

Referring now to FIGS. 28-33, there appears a fifth embodiment blank 100*e* and web 200*e* of connected blanks 100*e* which are used to form a fifth embodiment pack 300*e*. Except as otherwise specified, the above description of FIGS. 1-9 is equally applicable to FIGS. 28-33, which above description is incorporated here by reference.

Figure 28:
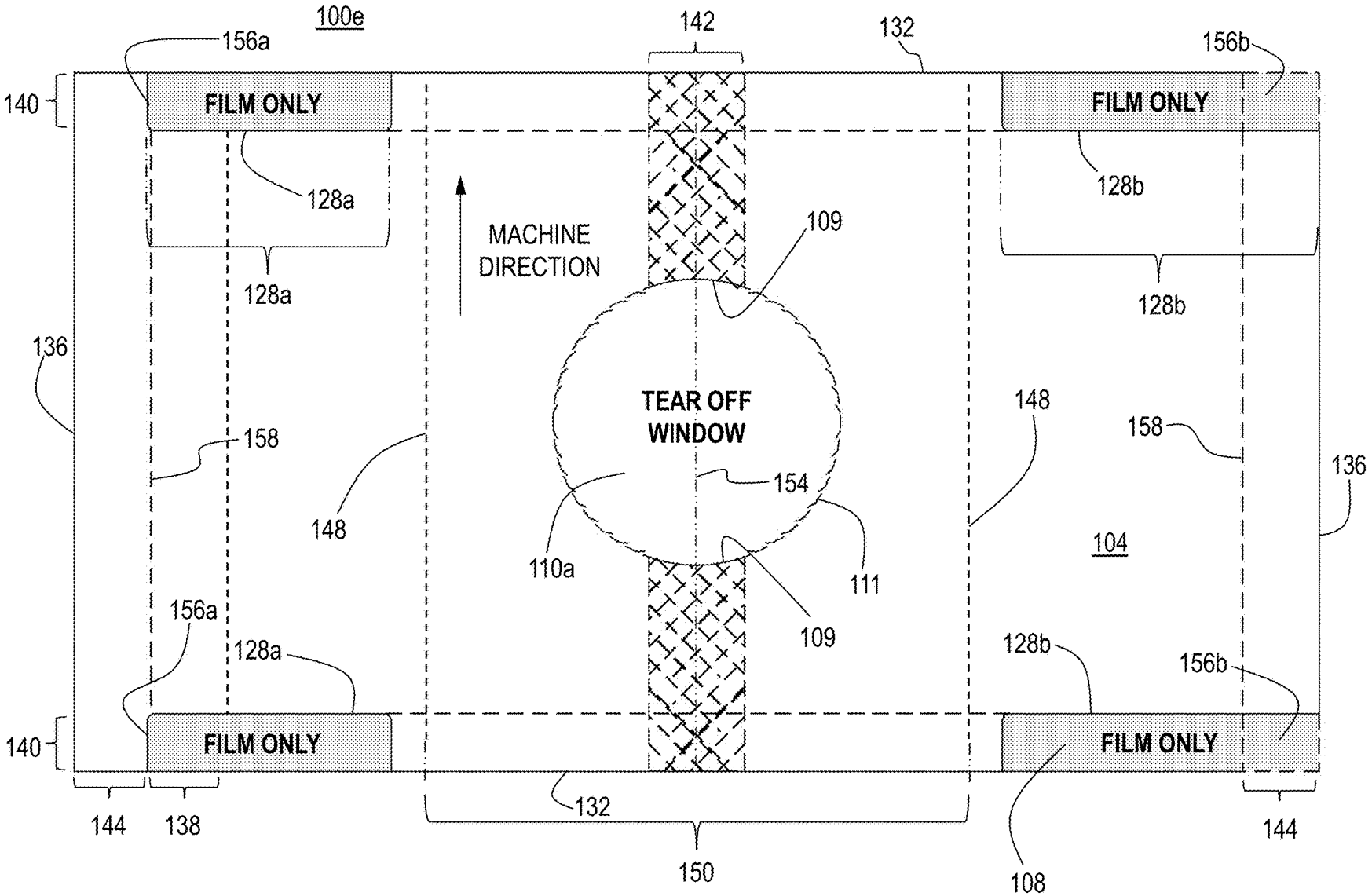
FIG. 28 is a top plan view of a fifth embodiment blank for producing a fifth embodiment pack in accordance with the present disclosure.
Figure 29:
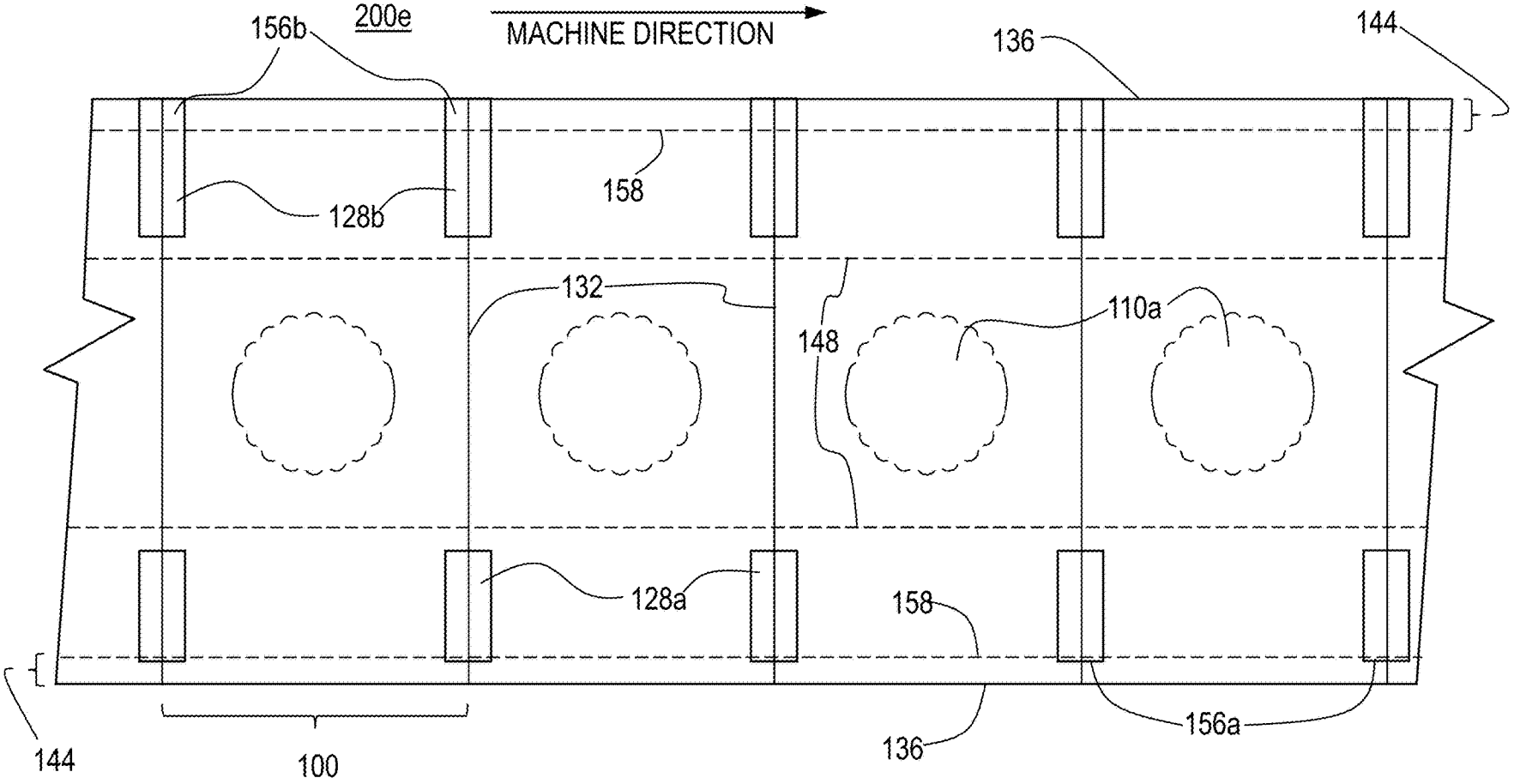
FIG. 29 is a top plan view of a sheet material comprising a continuous web of connected blanks of the type appearing in FIG. 28.

As best seen in FIG. 28, the blank 100*e* illustrates first and third cutouts 128*a* having a transverse extent that extends from a position approximately aligned with the medial edge line 158 of the first longitudinal heat seal region 144 to a position intermediate the medial edge line 158 and the first fold line 148. It will be recognized that a portion 156*a* of the first and third cutouts 128*a* may extend slightly beyond the medial edge line 158 of the first longitudinal heat seal region 144 toward the first longitudinal edge 136.

The second and fourth cutouts 128*b* have a transverse extent that extends from the second longitudinal edge 136 to a position intermediate the medial edge 158 of the second longitudinal heat seal region 144 and the second fold line 148, wherein a portion 156*b* of the second and fourth cutouts 128*b* comprises the entire intersection between the second longitudinal heat seal region 144 and the respective first and second longitudinal heat seal regions. By removing the outer ply material at the entire intersection between the second longitudinal heat seal region 144 and the respective first and second transverse heat seal regions 140, heat seal efficiency is improved in the first and second longitudinal heat seal regions 144 and adjacent to the transition between the fin seal 146 and the end seals. In addition, by removing the outer ply material at the entire intersection between the second longitudinal heat seal region 144 and the respective first and second transverse heat seal regions 140, while leaving the outer ply to cover all or substantially all of the intersection between the first longitudinal heat seal region 144 and the respective first and second longitudinal heat seal regions 140, there is no visible line on the fin seal where the fin seal intersects the end seals.

The blank embodiment 100*e* appearing in FIG. 28 also differs from the embodiment appearing in FIGS. 1-9 in that outer ply material is not removed in the region of the window 110, but rather, a tear off window region 110*a* is defined by a zipper perforation cuts 111 in the outer ply 104, e.g., by die cutting, for removal by the end consumer. Elongated perforations 109 may be provided to assist the user in tearing off the window portion 110*a*. It will be recognized that the embodiment 100*e* could alternatively employ the window 110 as described above. It will be recognized that any of the other embodiments 100*a*-100*d* could readily be modified to employ the tear and peel window 110*a* of the embodiment 100*e*.

Figure 31:
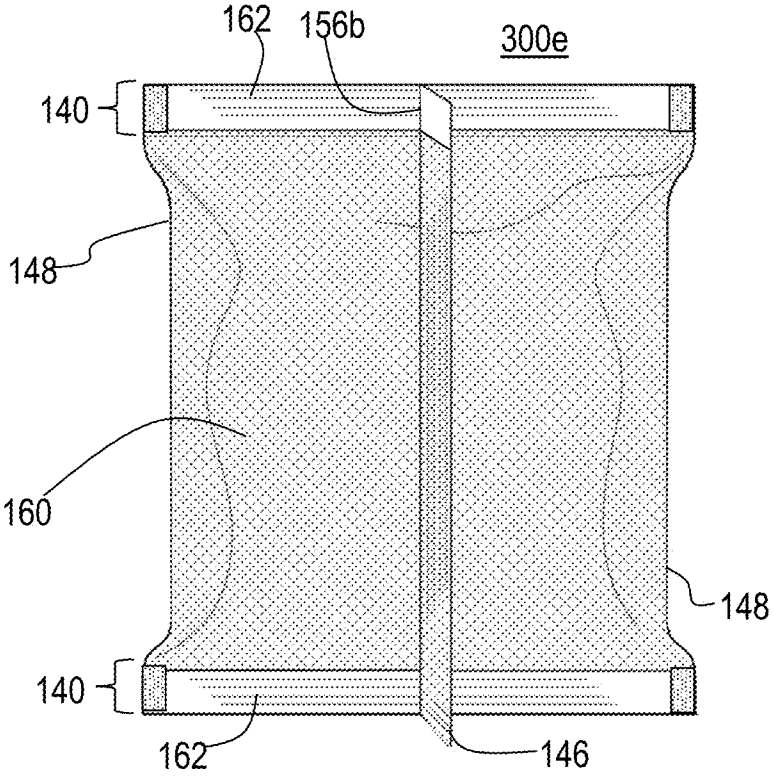
FIG. 31 is a rear view of the pack appearing in FIG. 30.
Figure 30:
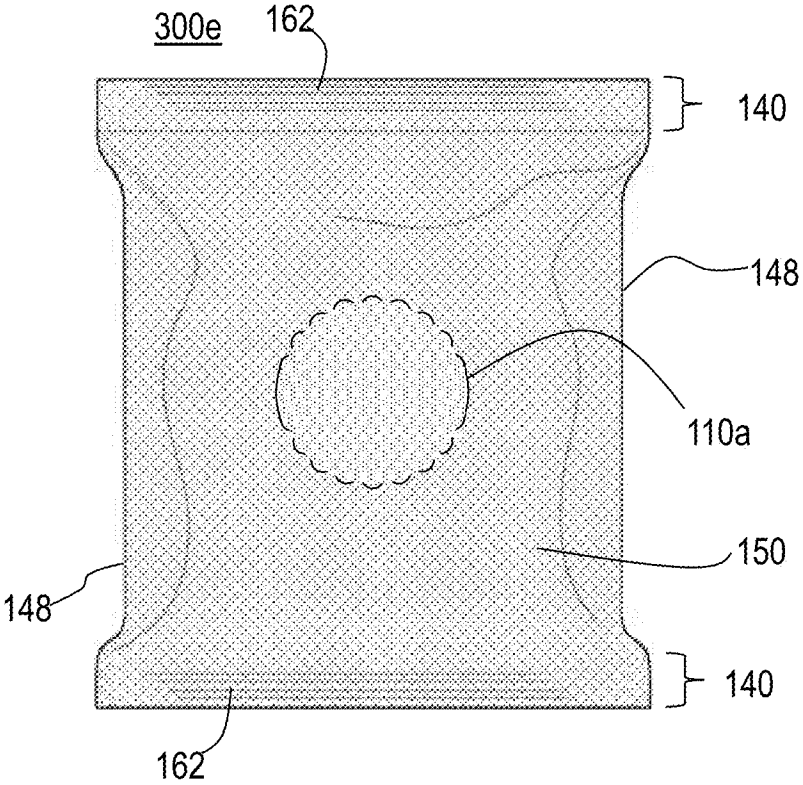
FIG. 30 is front view of the fifth embodiment pack formed from the fifth embodiment blank appearing in FIG. 28.
Figure 33:
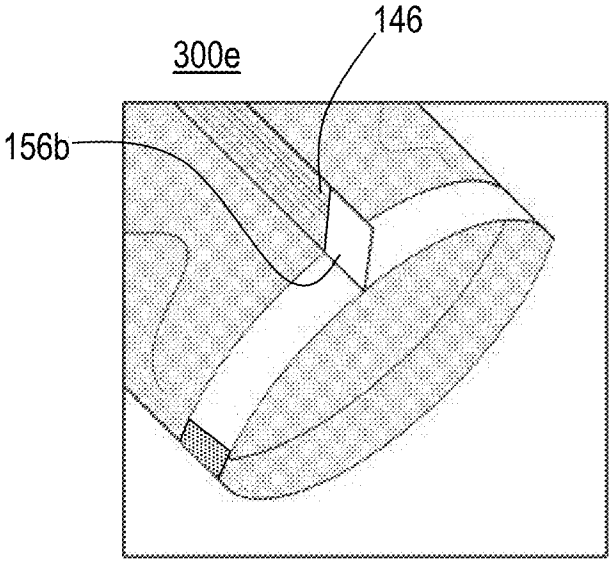
FIG. 33 is a fragmentary isometric view of the pack appearing in FIG. 30 with the end open.
Figure 32:
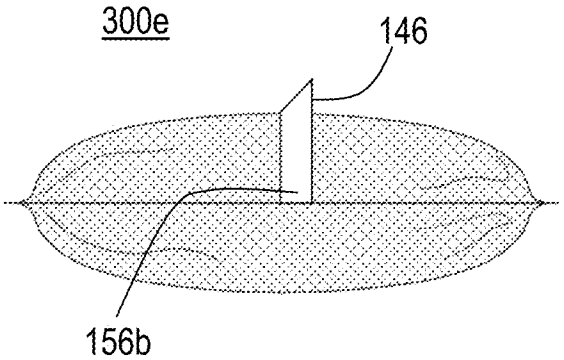
FIG. 32 is an end view of the pack appearing in FIG. 30.

Referring now to FIGS. 30-33, and with continued reference to FIGS. 1, 2, 28, and 29, there appears a pack 300*e* formed of the blank 100*e*. The blank 300*e* comprises the blank 100*e* folded generally around the long axis 154 to form a front panel 150, optionally with a peelable perforated window portion 110*a*, a rear panel 160 opposite the front panel 150 with longitudinal fin seal 146, and opposing transverse end seals 162. As best seen in FIGS. 31-33, the portions 156*b* of second and fourth cutouts 128*b* extend the entire transverse distance between the medial edge lines 158 to the longitudinal edge 136, while the portions 156*a* of first and third cutouts 128*a* extend to or only slightly past the corresponding medial edge lines 158 and do not extend into (or only extend slightly into) the first longitudinal heat seal region 144 where it meets the transverse heat seal region 140.

In yet a further embodiment, a sixth embodiment blank, web, and pack are as shown described above by way of reference to the blank 100*e*, corresponding web 200*e*, and pack 300*e* appearing in FIGS. 28-33, which description is incorporated here by reference, except that the first and third cutouts extend or continue through the first longitudinal heat seal region 144 all the way to the first longitudinal edge 136 such that the first and third cutouts thereby mirror the second and fourth cutouts.

Figure 34:
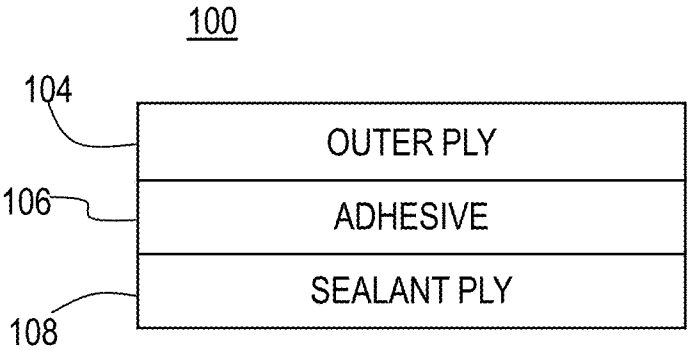
FIG. 34 is a general cross-sectional view of the laminated film material herein.

Referring now to FIG. 34, there is shown a side cross-sectional view of an exemplary web structure 100 comprising the outer ply 104, the sealant ply 108, and an adhesive layer 106 therebetween which adhesively laminates to the outer ply 104 and the sealant ply 108. The adhesive layer may be continuously applied or applied in a pattern, e.g., to accommodate optional windows in the outer ply 104, perforated regions in the sealant ply 108, and so forth. The adhesive layer 106 may be formed of any suitable adhesive, including single component adhesives, two component adhesives, solvent-based adhesives, solventless adhesives, water-based adhesives, acrylic adhesives, extruded polyethylene or polypropylene adhesive systems, electron beam lamination adhesives, and UV lamination adhesives, as would be understood by persons skilled in the art.

Figure 35:
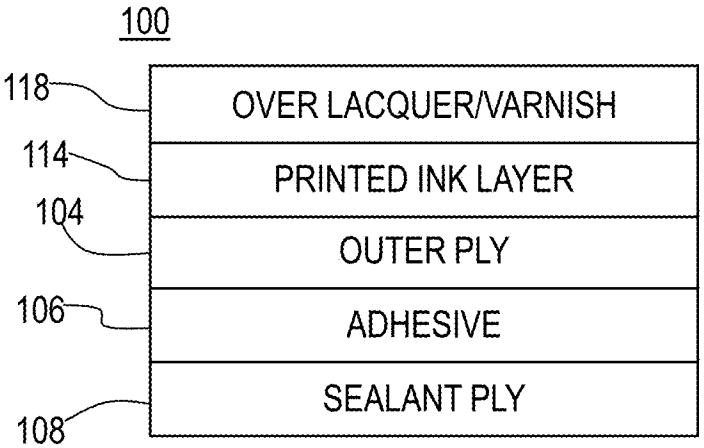
FIG. 35 is a general cross-sectional view of the laminated film material herein having printed indicia disposed on the outer ply.

Referring now to FIG. 35, there is shown a side cross-sectional view of a further embodiment web structure 100 comprising the outer ply 104, the sealant ply 108, and adhesive layer 106, as shown in FIG. 34, and further including a printed indicia layer 114 and a lacquer or varnish layer 118 disposed over the printed layer 114, e.g., to prevent the printed ink layer 114 from scuffing or rubbing off and/or to provide a desired matte or gloss effect.

The printing indicia layer 114 can be applied to the outer surface of the outer ply 104 via any conventional printing method as would be understood by persons skilled in the art, including without limitation, using a rotogravure printing apparatus, flexographic printing apparatus, offset printing apparatus, digital printing apparatus, ink jet printing apparatus, or the like.

In certain embodiments, the outer ply 104 comprises a paper layer. In embodiments, the paper layer is a bleached paper or natural paper, e.g., bleached or natural Kraft paper. Other preferred embodiments the paper is coated one side, C1S, or coated two side C2S to help with printing or further converting. In a CIS paper, the coating has been applied to only one side of the paper. C2S the coating is on both sides. In preferred embodiments, the paper is a bleached paper to provide improved printing characteristics as compared to its natural/unbleached counterpart. Bleached paper also has a lower stiffness as compared to its natural/unbleached counterpart to allow for improved runnability on flow wrap equipment. In embodiments, the basis weight of paper suitable for use in the outer ply 104 is in the range of 25 gsm to 170 gsm. In embodiments, the basis weight of paper suitable for use in the outer ply 104 is in the range of 28 gsm to 160 gsm. In embodiments, the basis weight of paper suitable for use in the outer ply 104 is in the range of 35 gsm to 150 gsm. In embodiments, the basis weight of paper suitable for use in the outer ply 104 is in the range of 55 gsm to 140 gsm. In embodiments, the basis weight of paper suitable for use in the outer ply 104 is in the range of 60 gsm to 130 gsm. In embodiments, the basis weight of paper suitable for use in the outer ply 104 is in the range of 70 gsm to 120 gsm. In embodiments, the basis weight of paper suitable for use in the outer ply 104 is in the range of 80 gsm to 120 gsm. In embodiments, the basis weight of paper suitable for use in the outer ply 104 is in the range of 70 gsm to 120 gsm. In embodiments, the basis weight of paper suitable for use in the outer ply 104 is in the range of 80 gsm to 110 gsm. In embodiments, the basis weight of paper suitable for use in the outer ply 104 is in the range of 90 gsm to 100 gsm. In preferred embodiments, the basis weight of paper suitable for use in the outer ply 104 is in the range of 60 gsm to 90 gsm, and more preferably 70 gsm. It will be recognized that paper basis weights other that those listed above are also contemplated.

In certain embodiments, the outer ply 104 comprises a monolayer or multilayer polymer material. If the outer ply 104 comprises a monolayer polymer material, it preferably includes polyolefins, such as polyethylene, polypropylene, including blends thereof and copolymers thereof (including ethylene vinyl acetate (EVA) and ethylene vinyl alcohol (EVOH), polyesters, such as polyethylene terephthalate, vinyl polymers, including polyvinylchloride (PVC) and polyvinyl alcohol (PVOH), biopolymers such as cellulose, starch, or sugar-based polymers, natural or synthetic biopolymers, or other films suitable as an outer web for packaging. In embodiments, such polymers further include a barrier coating such as metal oxides, such as silicone oxide, aluminum oxide, or combinations thereof, polymer barriers including polyvinyl alcohol, and other forms of barrier coatings, including metallization layers comprising aluminum or other metal metallization layer is formed from a deposition process on the polymer layer including sputter deposition physical vapor deposition (PVD) (including magnetron or ion beam), thermal evaporation PVD, and chemical vapor deposition CVD. Layers of foil or other barrier materials are also contemplated.

If the outer ply 104 comprises a multilayer polymer material, it may include multiple layers formed of the polymer materials described above, and any adhesive layers, tie layers, primer layers, and so forth, intermediate the polymer layers to promote adhesion or bonding of adjacent layers. If the outer ply 104 comprises a multilayer polymer material, the multilayer structure may be achieved through a single coextrusion process or through successive extrusion lamination, extrusion coating, or other type of coating operations.

Figure 36:
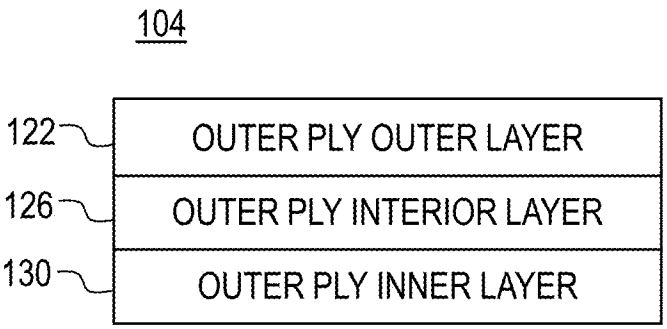
FIG. 36 is an exemplary cross-sectional view of the outer ply.

FIG. 36 illustrates an exemplary multilayer outer ply 104, which comprises an outer ply outer layer 122, an outer ply inner layer 130, and an outer ply interior layer 126 located between the outer ply outer layer 122 and the outer ply inner layer 130. Exemplary polymer materials include those described above and preferably include polyethylene, polypropylene, polyester, any biopolymers such as cellulose, starch or sugar-based polymers, natural or synthetic biopolymers, or other films suitable as an outer web for packaging. Some multi-material laminates may also include a metallized polypropylene, polyethylene, or polyester film, a foil or another liquid or vacuum coated barrier film. It will be recognized that the outer ply 104 may comprise other numbers of layers, including 2, 4, 5, 6, 7, 8, 9, 10, or more.

In certain embodiments, the sealant ply 108 comprises a monolayer or multilayer material. If the sealant ply 108 comprises a monolayer material, it should be formed of a material which is capable of forming a bond with itself or like material upon exposure to heat and pressure for a relatively short dwell time. If the sealant ply 108 comprises a monolayer material, it may include the materials described above, more preferably scalable paper, polyethylene, polypropylene, polyester, any biopolymers such as cellulose, starch or sugar-based polymers, natural or synthetic biopolymers, or other films suitable as a sealing web for flexible packaging. Such layers may also include a metalized, coated or vacuum coated barrier coating such as aluminum oxide, silicon oxide, PVOH or other barrier coatings. If the sealant ply 108 comprises a multilayer material, it preferably includes scalable paper, propylene ethylene copolymer, high density ethylene copolymer, polypropylene copolymer, polyester copolymer, and laminations of the above to a range of barrier or non-barrier films. If the sealant ply 108 comprises a multilayer material, the multilayer structure may be achieved through a single coextrusion process or through successive extrusion lamination, extrusion coating, or other coating operations.

Figure 37:
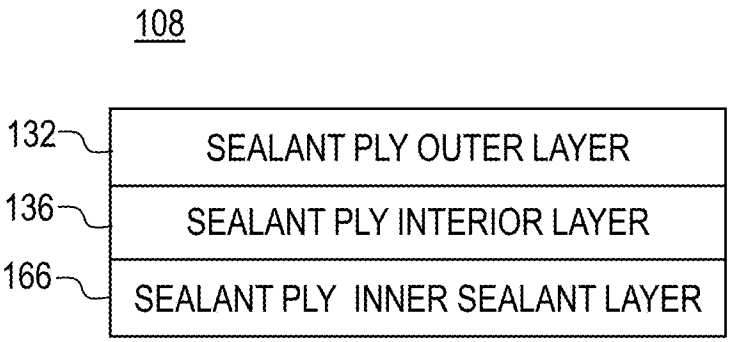
FIG. 37 is an exemplary cross-sectional view of the sealant ply.

FIG. 37 illustrates an exemplary multilayer sealant ply 108, which comprises a sealant ply outer layer 132, a sealant ply inner sealant layer 166, and a sealant ply interior layer 136 located between the sealant ply outer layer 132 and the sealant ply inner sealant layer 166. At least the sealant ply inner sealant layer 166 should be formed of a material which is capable of forming a bond with itself or like material upon exposure to heat and pressure for a relatively short dwell time. Exemplary materials include the materials described above, more preferably polyethylene, polypropylene, polyester, any biopolymers such as cellulose, starch or sugar-based polymers, natural or synthetic biopolymers, or other films suitable as a scaling web for flexible packaging. It will be recognized that the sealant ply 108 may comprise other numbers layers, including 2, 4, 5, 6, 7, 8, 9, 10, or more.

Figure 38:
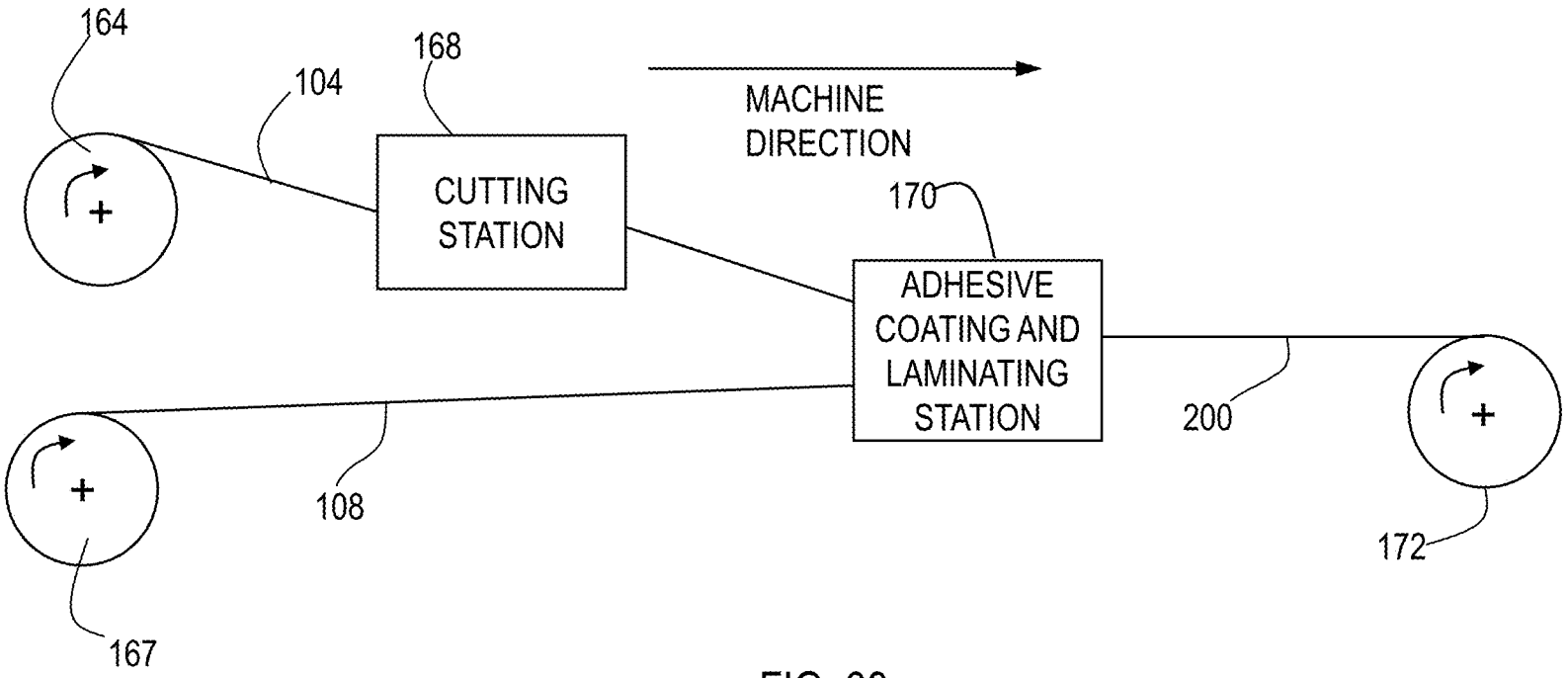
FIG. 38 is an exemplary process flow line for forming the sheet materials in accordance with the present disclosure.

Referring now to FIG. 38, there is shown an exemplary process line for forming a web 200 comprising a series of connected blanks 100. The outer ply web 104 is unrolled from a roll 164 and fed toward a cutting station 168 where the notches 128 and, optionally the windows 110, are cut. In embodiments, the notches 128 and optional windows 110 are cut from the web 200 using cutting dies in a die-cut process. The outer ply web 104 is then fed to an adhesive coating and laminating station 170. It will be recognized that separate adhesive coating and laminating stations may be employed.

The sealant ply web 108 is unrolled from a roll 167 and fed toward a laminating station 170 where the outer ply web 104 and the sealant ply web 108 are adhesively joined via the adhesive 106 to form the laminate 200. In certain embodiments, the adhesive 106 may be continuously applied or pattern applied to outer major surface of sealant ply web 108 or inner major surface of the of outer ply web 104. The adhesive may be applied using any suitable coating technique, such as roll coating, roll-to-roll coating, various types of gravure coating, flexographic coating, bar coating, doctor blade coating, comma coating, spraying, or brush coating, in any suitable pattern.

Lamination may be accomplished using a laminating machine comprising two rollers forming a nip therebetween, or may be accomplished using any other method as would be known to persons skilled in the art. The adhesive 106 may optionally be dried using an oven or the like, or could crosslink through a chemical reaction or using UV, E-beam or other curing methods. Optional vents or windows can be applied to either layer. Adhesive is generally void in these areas. After exiting the adhesive coating and laminating station 170, the web 200 is wound up on a wind-up roll 172. Alternatively, in embodiments, the wind up roll 172 may be omitted and the web 200 may be fed directly to a flow wrap fixture 178 as shown in FIG. 39 or 40 in a single process line.

Figure 39:
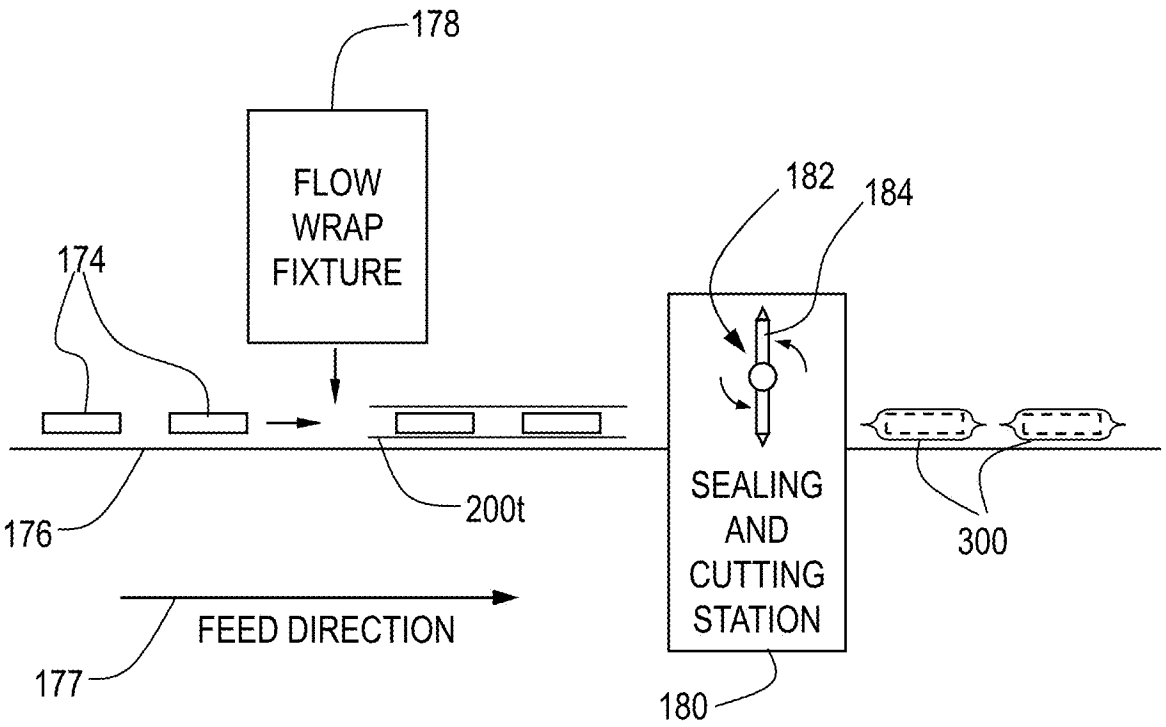
FIGS. 39 and 40 are exemplary process flow lines for utilizing the sheet materials in accordance with the present disclosure.

Referring now to FIG. 39, the web 200 is fed to a flow wrap fixture 178 and products 174 are provided on a conveyor system 176 of a type as would be understood by persons skilled in the art. The conveyor system 176 feeds the product 174 in the feed direction as indicated generally by the arrow 177. The conveyor system 176 feeds the products 174 to the flow wrap fixture 178. The flow wrap fixture 178 disposes the products 174 within the web 200. In certain embodiments, web 200 is fed out in a continuous manner and manipulated and guided to be folded or wrapped longitudinally to thereby become disposed around the products 174. The opposing longitudinal edges 136 of the web 200 are then sealed to one another in the heat seal regions 144 by any suitable method, such as by a pair of opposing sealing wheels. This process provides a continuous tubular flow wrapper 200*t* disposed around multiple instances of the product 174 as the wrapper flows in the feed direction 177.

The conveyor system 176 then feeds the products 174 disposed within the flow wrapper 200*t* to a sealing and cutting station 180. The sealing and cutting station 180 includes a rotary drum 182 having one or more heated sealing and cutting heads 184 which simultaneously form the end seals 162 in the heat seal regions 140 and separate the flow wrapper 200*t* into the individual packs 300.

Figure 40:
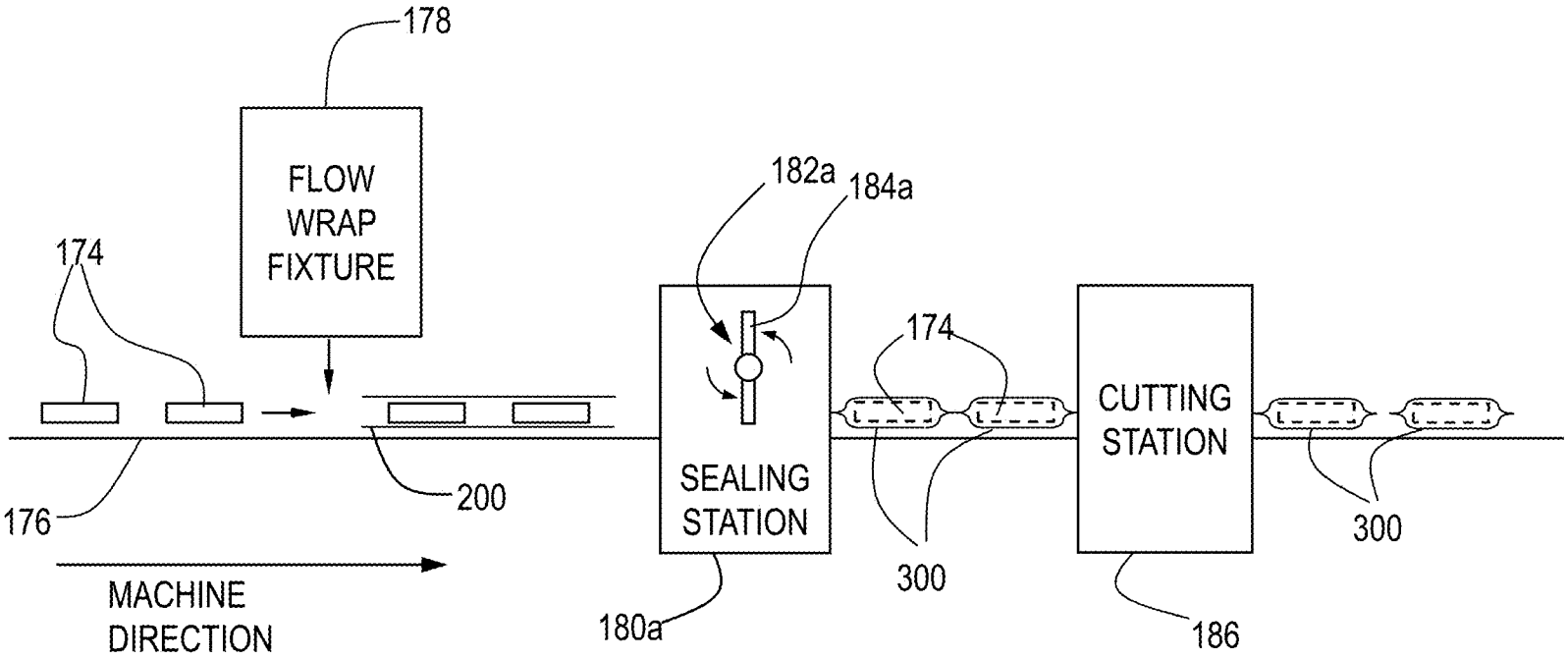

In alternative embodiments, the sealing and cutting station 180 is replaced with a sealing station 180*a* and a separate cutting station 186 as shown in FIG. 40. The scaling station 180*a* includes a rotary drum 182*a* having one or more heated sealing heads 184*a* which form the end seals 162 in the heat seal regions 140. The conveyor system 176 then feeds the flow wrapper with wrapped products 174 to the cutting station 186 which separates the flow wrapper 200*t* into the individual packs 300.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A web of sheet material which can be wrapped around a product to form a pack, the sheet material comprising:

a sealant ply laminated to an outer ply;

the sealant ply having a first major surface and a second major surface opposite the first major surface, the first major surface comprising a heat sealable material;

the outer ply having a third major surface and a fourth major surface opposite the third major surface, wherein the third major surface faces the second major surface;

the web of sheet material comprising a plurality of connected blanks, each blank comprising:

a first longitudinal edge extending in a machine direction;

a second longitudinal edge extending in the machine direction, the second longitudinal edge opposite the first longitudinal edge;

a first transverse edge extending in a transverse direction; and a second transverse edge extending in the transverse direction, the second transverse edge spaced apart from the first transverse edge in the machine direction;

a first longitudinal heat seal region extending along the first longitudinal edge from the first transverse edge to the second transverse edge;

a second longitudinal heat seal region extending along the second longitudinal edge from the first transverse edge to the second transverse edge, the first longitudinal heat seal region heat sealable to the second longitudinal heat seal region to form a longitudinal heat seal;

a first longitudinal fold line extending from the first transverse edge to the second transverse edge, the first longitudinal fold line disposed intermediate a longitudinal center axis and the first longitudinal edge;

a second longitudinal fold line extending from the first transverse edge to the second transverse edge, the second longitudinal fold line disposed intermediate the longitudinal center axis and the second longitudinal edge;

a first transverse heat seal region extending along the first transverse edge from the first longitudinal edge to the second longitudinal edge, wherein a first portion of the first transverse heat seal region is configured to form a heat seal with a second portion of the first transverse heat seal region, wherein the first portion of the first transverse heat seal region faces the second portion of the first transverse heat seal region when the blank is folded along the first longitudinal fold line, and wherein a third portion of the first transverse heat seal region is configured to form a heat seal with a fourth portion of the first transverse heat seal region, wherein the third portion of the first transverse heat seal region faces the fourth portion of the first transverse heat seal region when the blank is folded along the second longitudinal fold line;

a second transverse heat seal region extending along the second transverse edge from the first longitudinal edge to the second longitudinal edge, wherein a first portion of the second transverse heat seal region is configured to form a heat seal with a second portion of the second transverse heat seal region, wherein the first portion of the second transverse heat seal region faces the second portion of the second transverse heat seal region when the blank is folded along the first longitudinal fold line, and wherein a third portion of the second transverse heat seal region is configured to form a heat seal with a fourth portion of the second transverse heat seal region, wherein the third portion of the second transverse heat seal region faces the fourth portion of the second transverse heat seal region when the blank is folded along the second longitudinal fold line;

a first cutout removing a portion of the outer ply aligned with the first portion of the first transverse heat seal region;

a second cutout removing a portion of the outer ply aligned with the fourth portion of the first transverse heat seal region;

a third cutout removing a portion of the outer ply aligned with the first portion of the second transverse heat seal region; and a fourth cutout removing a portion of the outer ply aligned with the fourth portion of the second transverse heat seal region;

wherein a portion of the outer ply extends into each of the first and second longitudinal heat seal regions.

2. The web of sheet material of claim 1, wherein the outer ply comprises a paper layer.

3. The web of claim 1, further comprising:

the first cutout and third cutout each extending from the first longitudinal heat seal region to a point intermediate the first longitudinal fold line and the longitudinal center axis; and the second cutout and fourth cutout each extending from the second longitudinal heat seal region to a point intermediate the second longitudinal fold line and the longitudinal center axis.

4. The web of claim 3, further comprising:

the first cutout and third cutout each transversely extending at least partially into the first longitudinal heat seal region; and the second cutout and fourth cutout each transversely extending at least partially into the second longitudinal heat seal region.

5. The web of claim 1, further comprising:

the first cutout and third cutout each extending from the first longitudinal heat seal region to the first longitudinal fold line; and the second and fourth cutout each extending from the second longitudinal heat seal region to the second longitudinal fold line.

6. The web of claim 1, further comprising:

the first cutout and third cutout each transversely extending at least partially into the first longitudinal heat seal region; and the second cutout and fourth cutout each transversely extending at least partially into the second longitudinal heat seal region.

7. The web of claim 1, wherein a front panel is defined by the sheet material disposed between the first longitudinal fold line and the second longitudinal fold line.

8. The web of claim 7, wherein the front panel further comprises a window defined by a cutout in the outer ply.

9. The web of claim 7, wherein the front panel further comprises a window region covered by a tear-away perforated panel.

10. The web of claim 9, wherein the tear-away perforated panel comprises zipper-like perforations.

11. The web of claim 1, further comprising a plurality of perforations in the sealant ply.

12. The web of claim 1, wherein the sealant ply comprises an anti-fogging agent.

13. The web of claim 12, wherein the anti-fogging agent is applied as a coating layer on the first major surface.

14. The web of claim 1, further comprising:

the second cutout and fourth cutout each transversely extending for entire transverse extent of the second longitudinal heat seal region, wherein the first cutout and third cutout each do not substantially extend into the first longitudinal heat seal region.

15. A packaging blank formed of the web of claim 1.

16. A packaging blank formed of the web of claim 2.

17. A packaging blank formed of the web of claim 3.

18. A package formed of the web of claim 1.

19. A package formed of the web of claim 2.

20. A package formed of the web of claim 3.

* * * * *